US011795583B2

(12) United States Patent
Dai et al.

(10) Patent No.: US 11,795,583 B2
(45) Date of Patent: Oct. 24, 2023

(54) PLASTICIZED MELT SPINNING PROCESS USING IONIC LIQUIDS FOR PRODUCTION OF POLYACRYLONITRILE FIBERS

(71) Applicants: UT-Battelle, LLC, Oak Ridge, TN (US); University of Tennessee Research Foundation, Knoxville, TN (US)

(72) Inventors: Sheng Dai, Knoxville, TN (US); Huimin Luo, Knoxville, TN (US); Halie J. Martin, Huntsville, AL (US)

(73) Assignees: UT-Battelle, LLC, Oak Ridge, TN (US); University of Tennessee Research Foundation, Knoxville, TN (US)

( * ) Notice: Subject to any disclaimer, the term of this patent is extended or adjusted under 35 U.S.C. 154(b) by 0 days.

(21) Appl. No.: 17/580,851

(22) Filed: Jan. 21, 2022

(65) Prior Publication Data

US 2022/0235493 A1 Jul. 28, 2022

Related U.S. Application Data

(60) Provisional application No. 63/139,833, filed on Jan. 21, 2021.

(51) Int. Cl.

| | |
|---|---|
| ***D01D 5/08*** | (2006.01) |
| ***D01D 10/06*** | (2006.01) |
| ***D01F 6/18*** | (2006.01) |
| ***D01F 9/22*** | (2006.01) |
| ***D01F 6/54*** | (2006.01) |
| ***D01D 5/10*** | (2006.01) |

(52) U.S. Cl.

CPC ..... *D01F 6/54* (2013.01); *D01D 5/10* (2013.01); *D01F 9/225* (2013.01); *D10B 2321/10* (2013.01)

(58) Field of Classification Search

CPC .. D01D 5/08; D01D 10/06; D01F 6/18; D01F 9/22; D01F 9/225

USPC ..... 264/29.2, 29.6, 29.7, 176.1, 211.14, 264/211.15, 211.17, 233; 423/447.7, 423/447.8

See application file for complete search history.

(56) References Cited

U.S. PATENT DOCUMENTS

| | | | | |
|---|---|---|---|---|
| 8,129,543 | B2 | 3/2012 | Kawada et al. | |
| 2010/0120969 | A1* | 5/2010 | Tsotsis | D01F 9/22 423/447.2 |
| 2010/0310853 | A1* | 12/2010 | Schwiegk | C08J 9/28 264/48 |
| 2012/0027944 | A1* | 2/2012 | Yu | D01F 9/22 264/29.2 X |

FOREIGN PATENT DOCUMENTS

| | | | | |
|---|---|---|---|---|
| CN | 103924313 A | * | 7/2014 | D01F 1/10 |

OTHER PUBLICATIONS

Translation of CN 103924313 A (published on Jul. 16, 2014).*

Frank, E., et al., "Carbon Fibers: Precursors, Manufacturing, and Properties", Macromolecular Materials and Engineering 2012, Published Online May 10, 2012, pp. 493-501, 297.

Frank, E., et al., "Carbon Fibers: Precursor Systems, Processing, Structure, and Properties", Angew. Chem. Int. Ed. 2014, Published Online Mar. 25, 2014, pp. 5262-5298, 53.

Liu, S., et al., "Structure and Properties of Partially Cyclized Polyacrylonitrile-Based Carbon Fiber—Precursor Fiber Prepared by Melt-Spun With Ionic Liquid as the Medium of Processing", Polymer Engineering and Science, 2015, pp. 2722-2728.

Wang, Z., et al., "Controlling the elasticity of polyacrylonitrile fibers via ionic liquids containing cyano-based anions", RSC Adv., 2022, Accepted Mar. 7, 2022, pp. 8656-8866, 12.

* cited by examiner

*Primary Examiner* — Leo B Tentoni

(74) *Attorney, Agent, or Firm* — Scully, Scott, Murphy & Presser, P.C.

(57) ABSTRACT

A method for producing polyacrylonitrile (PAN) fiber, the method comprising: (i) mixing PAN with an ionic liquid in which the PAN is soluble to produce a PAN composite melt in which the PAN is dissolved in the ionic liquid; (ii) melt spinning the PAN composite melt to produce the PAN fiber; and (iii) washing the PAN fiber with a solvent in which the ionic liquid is soluble to substantially remove the ionic liquid from the PAN fiber. Also described herein is a method for producing carbon fiber from the PAN fiber as produced above, the method comprising oxidatively stabilizing the PAN fiber produced in step (iii), followed by carbonizing the stabilized PAN fiber to produce the carbon fiber. The initially produced PAN fiber, stabilized PAN fiber, resulting carbon fiber, and articles made thereof are also described.

24 Claims, 15 Drawing Sheets

Imidazolium:

n = 0, 1, 2, 3, 4, 5, 6, 7, 8

Pyridinium:

n = 0, 1, 2, 3, 4, 5, 6, 7, 8

Pyrolidium:

n = 1, 2, 3, 5

13A

13B

PLASTICIZED MELT SPINNING PROCESS USING IONIC LIQUIDS FOR PRODUCTION OF POLYACRYLONITRILE FIBERS

CROSS REFERENCE TO RELATED APPLICATION

The present application claims benefit of U.S. Provisional Application No. 63/139,833, filed on Jan. 21, 2021, all of the contents of which are incorporated herein by reference.

STATEMENT REGARDING FEDERALLY SPONSORED RESEARCH

This invention was made with government support under Prime Contract No. DE-AC05-000R22725 awarded by the U.S. Department of Energy. The government has certain rights in the invention.

FIELD OF THE INVENTION

The present invention generally relates to methods for producing polyacrylonitrile (PAN) fiber by melt-spinning and solution spinning processes, and methods for producing carbon fiber from PAN fiber. The present invention more specifically relates to a plasticized melt spinning process in which an ionic liquid is used for producing PAN fiber.

BACKGROUND OF THE INVENTION

Carbon fiber and composites thereof are increasingly being employed as structural materials in various industries, in large part due to their high strength and low weight. The applications include, for example, the automotive, sports, aviation, tools, and military equipment. As the cost of carbon fiber continues to fall, the market for carbon fiber continues to expand. The carbon fiber industry has been steadily growing with an emphasis in aerospace, military construction, automotive, and sporting goods technology. Commercially available high-strength carbon fibers exhibit exceptional mechanical properties with combination of tensile strengths reaching 7 GPa and tensile moduli upwards of 324 GPa. The high specific strength and tensile modulus of carbon fibers make them a superior lightweight structural material compared to other reinforcement materials. Carbon fibers also exhibit high environmental durability.

The most common polymeric precursor for carbon fibers is polyacrylonitrile (PAN) due to the high strain to failure in the resulting carbonized filaments. PAN is a polymer precursor known to provide high-strength carbon fiber. However, the production of high strength carbon fiber is an energy intensive and costly process. A significant portion of the high cost is attributed to the production of PAN fibers prior to carbon fiber production. The currently most widely used technology for PAN fiber production is a solution spinning process, commonly referred to as wet spinning. In this process, the fibers are dissolved in a solvent and fed through coagulation and rinse baths to remove the solvent and produce fibers. This intensive process is inherently inefficient.

Melt spinning, as opposed to wet spinning, has also been attempted for producing PAN fibers, in an effort to reduce production costs. However, melt-spinning virgin PAN and many PAN copolymers used to produce high strength carbon fibers is not possible due to polymer degradation at sub-melt temperatures. The strong dipole-dipole interaction between nitrile groups in PAN lead to its degradation before melting, which makes a melt-spinning process non-viable. More specifically, PAN undergoes a thermally induced crosslinking reaction prior to reaching the crystalline melting temperature (~317° C.).

In view of the obstacles involved in melt-spinning PAN fibers, commercially available PAN-based fibers are conventionally manufactured through wet spinning, as described above. However, wet spinning requires tedious manufacturing steps and extensive capital investment. Due to the nitrile groups of PAN, which feature strong dipole-dipole interactions, PAN is only soluble in highly polar solvents, such as DMF and DMSO. Wet spinning PAN fibers from solution processes requires multiple unit operations resulting in high production costs. In addition to the capital costs, use of expensive and environmentally harmful solvents for preparing the PAN precursor contribute significantly to the production cost and risk to the environment and human health. The high costs are also exacerbated by the need for pressure vessels used for hydrogen storage, which may amount to as much as 75% of the total system cost for producing the carbon fiber.

Thus, there would be a significant advantage in a process for producing PAN fiber that is substantially less energy intensive, less costly, and less reliant on toxic and environmentally unfriendly solvents. There would be a further advantage in a PAN fiber production process that can provide a higher carbon yield during carbonization. Moreover, as the conventional stabilization process for PAN fiber is generally energy intensive and costly, there would be a further advantage in a PAN stabilization process that can operate under milder conditions. Moreover, the conventional process for producing carbon fiber often results in carbon fiber with lower than optimal strength or physical integrity for critical applications. Thus, there would also be an advantage in a PAN fiber production process that could impart improved mechanical properties in the resulting carbon fiber.

SUMMARY OF THE INVENTION

In one aspect, the present disclosure is directed to a novel plasticized melt spinning method for producing PAN fiber. In the method, PAN fiber is produced by melt spinning a composite containing PAN dissolved in an ionic liquid. The method overcomes a number of disadvantages of the conventional methods. At the outset, the method is advantageously less energy intensive, less costly, and not reliant on toxic and environmentally unfriendly solvents, compared to conventional methods. The PAN fiber production process described herein can also advantageously provide a higher carbon yield during carbonization. The PAN fiber production process described herein also advantageously permits a milder stabilization process on the PAN fiber before the carbonization process. The PAN fiber production process described herein also advantageously endows the resulting carbon fiber (produced by stabilization and carbonization of the PAN fiber) with improved mechanical properties, such as improved strength and toughness. The PAN fiber production process described herein also advantageously permits the ionic liquid to be recycled by separation of the ionic liquid from the solvent used in the washing step followed by re-use of the ionic liquid in the same or different process.

More particularly, the PAN fiber production process may include at least the following steps: (i) mixing PAN with an ionic liquid in which the PAN is soluble to produce a PAN composite melt in which the PAN is dissolved in the ionic liquid; (ii) melt spinning the PAN composite melt to produce the PAN fiber; and (iii) washing the PAN fiber with a solvent in which the ionic liquid is soluble to substantially remove the ionic liquid from the PAN fiber. In particular embodiments, the ionic liquid does not contain chloride as an anion. In some embodiments, the anion of the ionic liquid is selected from bromide, iodide, carboxylate, sulfate, bisulfate, sulfite, bisulfite, sulfonates, carboxylates, dicyanamide, tricyanamide, sulfonimides, phosphinates, and perchlorate. In particular embodiments, the ionic liquid is or contains bromide as an anion. In separate or further embodiments, the cation of the ionic liquid contains at least one nitrogen atom, or the cation more particularly possesses an imidazolium ring. In some embodiments, the solvent used in the washing step is aqueous based, such as deionized water or an aqueous alcohol solution. In some embodiments, the washing step may be omitted, particularly if the ionic liquid contains an anion other than chloride or if the anion is specifically bromide, or if the cation portion contains a nitrile group.

The washing step serves to substantially or completely remove the ionic liquid. The washing step, in particular, has herein been found to provide a number of unexpected advantages. A first advantage of the washing step is a higher carbon yield upon carbonization of the PAN fiber. A second advantage of the washing step is that it promotes cyclization of the PAN polymer chain, which, in turn, permits the use of a less harsh stabilization process (i.e., lower temperature and/or less processing time). A third advantage of the washing step is that it results in PAN fiber and resulting carbon fiber having fewer voids and defects, which corresponds to greater structural integrity, particularly greater strength and toughness (e.g., increased elastic modulus and tensile strength), and enhancement of other mechanical properties. A fourth advantage of the washing step is that it permits recycling (i.e., re-use) of the ionic liquid that has been removed from the PAN fiber, thereby reducing costs and avoiding waste.

In another aspect, the present disclosure is directed to a method for producing carbon fiber by subjecting the above-described PAN fiber to oxidative stabilization (optionally, under tension) and carbonization steps. In some embodiments, the carbon fiber is further subjected to a graphitization step. As mentioned earlier above, the above-described PAN fiber production process advantageously permits a milder stabilization process on the PAN fiber before the carbonization process. The stabilization process may, for example, be conducted at a temperature of no more than or less than 200° C., 180° C., or 150° C. and/or over a shorter than conventional stabilizing time period of no more than or less than, for example, 90, 80, 60, 45, or 30 minutes. The PAN fiber production process described herein also advantageously endows the resulting carbon fiber (produced by stabilization and carbonization of the PAN fiber) with improved mechanical properties, such as improved strength and toughness, and in the substantial absence of physical defects that could compromise structural integrity.

BRIEF DESCRIPTION OF THE FIGURES

FIG. 1A shows structures of some ionic liquids studied: [$C_3$mim]Br (A), [$C_4$mim]Br (B), [$C_4$mim]Cl (C), [MPCNIm]Br (D), and [MPCNIm]Cl (E). FIG. 1B shows structures of a range of exemplary ionic liquids useful in the present invention.

FIG. 6A shows a spinner head of the melt spinning apparatus used. FIG. 6B shows spun fibers on a spool in the melt spinning apparatus used.

DETAILED DESCRIPTION OF THE INVENTION

Figure 1A:
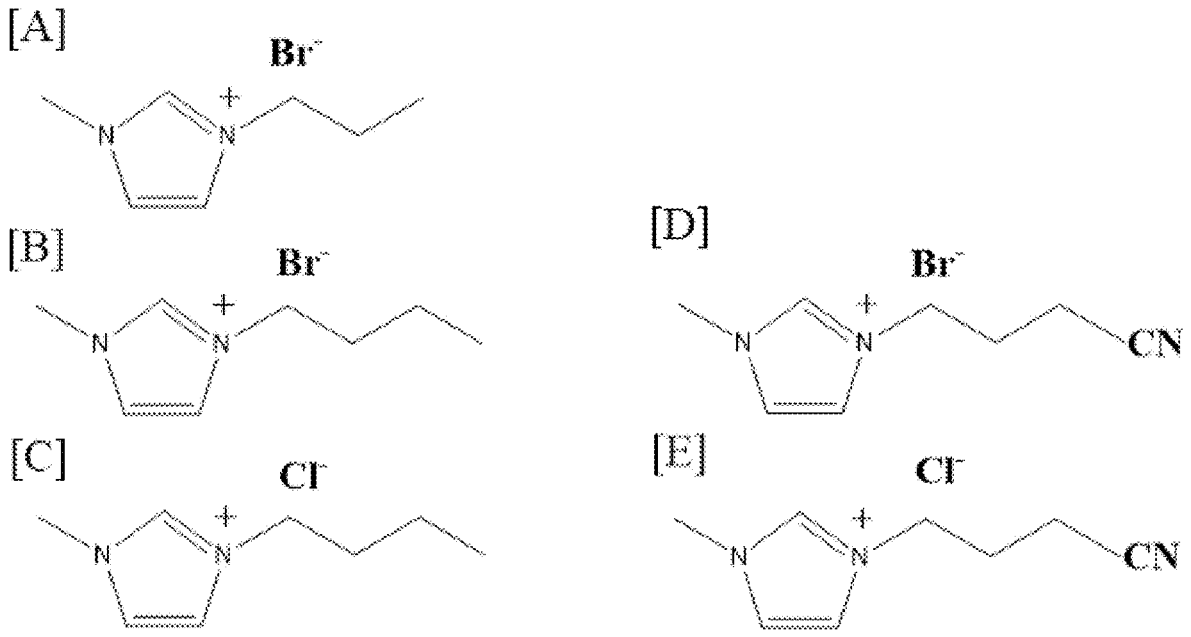
FIGS. 1A-1B.

In a first aspect, the present disclosure is directed to a method for producing polyacrylonitrile (PAN) fiber by a novel plasticized melt spinning method. The method described herein provides a number of improvements over conventional methods of the art for at least the following reasons: (i) the method is less energy intensive and less costly; (ii) the method is not reliant on toxic and environmentally unfriendly solvents, compared to conventional methods; (iii) the method can advantageously provide a higher carbon yield during carbonization; (iv) the method advantageously permits a milder stabilization process on the PAN fiber before the carbonization process; (v) the method advantageously endows the resulting carbon fiber (produced by stabilization and carbonization of the PAN fiber) with improved mechanical properties, such as improved strength and toughness; and (vi) the method advantageously permits the ionic liquid to be recycled by separation of the ionic liquid from the solvent used in the washing step followed by re-use of the ionic liquid in the same or different process. As noted earlier above, the washing step plays a significant role in at least some of these improvements.

The term "polyacrylonitrile" (i.e., "PAN"), as used herein, refers to any composition containing at least a block of PAN and which can be dissolved in an ionic liquid and is capable of being formed into a fiber by a spinning process. The term "fiber" may refer to a single fiber or a tow of fibers, as well known in the art. The PAN starting material used (i.e., being mixed with the ionic liquid) herein can be commercially obtained, or it can be produced by well known polymerization methods. The PAN polymer may, in some embodiments, be a homopolymer of PAN, i.e., composed solely of PAN. In other embodiments, the PAN is composed of PAN and another (i.e., non-PAN) polymer. PAN that includes at least one non-PAN polymer is typically in the form of a PAN-containing copolymer. The copolymer contains PAN along with one or more types of non-PAN monomer units (or one or more blocks or segments of non-PAN polymer). The PAN in such copolymers can be in a primary amount (i.e., greater than 50 mol %), secondary amount (i.e., less than 50 mol %), or equal amount. The copolymer can be, for example, a block, random, alternating, or graft copolymer.

The PAN may also be composed of a non-copolymer composite of PAN and one or more other polymers. The PAN composite can be in the form of, for example, an admixture of PAN and one or more non-PAN polymers, wherein the admixture may be homogeneous or heterogeneous. For example, the precursor PAN may be in admixture with one or more other polymers when mixed with the ionic liquid. Alternatively, the PAN fiber produced by the spinning method may be placed in tow with fibers of another polymer, e.g., by interweaving or wrapping when spun from the PAN composite melt containing the ionic liquid.

The non-PAN copolymer units are typically addition polymers derived from any of the unsaturated (generally, olefin) monomer precursors known in the art for producing such polymers. In particular embodiments, the non-PAN copolymer units are derived from unsaturated carboxylate precursor molecules, unsaturated amide precursor molecules, or a combination thereof. The unsaturated carboxylate precursor molecule generally contains at least one carbon-carbon double bond and a carboxylic acid or carboxylic ester group, wherein the olefinic group is often bound to the carbonyl carbon atom of the carboxylic acid or carboxylic ester group. Some examples of unsaturated carboxylate precursor molecules include methyl acrylate, ethyl acrylate, propyl acrylate, butyl acrylate, methyl methacrylate, (2-hydroxyethylacrylate), vinyl acetate, acrylic acid, methacrylic acid, and itaconic acid. PAN-acrylic acid copolymers, in particular, are often used in place of pure PAN polymer. The unsaturated amide precursor molecule generally contains at least one carbon-carbon double bond and an amide group (which can be N-substituted or N,N-disubstituted), wherein the olefinic group is often bound to the carbonyl carbon atom of the amide group. Some examples of unsaturated amide precursor molecules include acrylamide, methacrylamide, N-alkyl derivatives thereof, N,N-dialkyl derivatives thereof, and vinylpyrrolidone. Other copolymers of PAN include, for example, styrene-acrylonitrile (SAN), acrylonitrile-butadiene-styrene (ABS), polybutadiene-acrylic acid-acrylonitrile terpolymer (PBAN), acrylonitrile styrene acrylate (ASA), and vinylidene chloride-acrylonitrile. In some embodiments, one or more of any of the above disclosed precursor molecules or block portions thereof are excluded from the PAN, or the PAN may be a homopolymer of PAN, which may or may not be admixed or bonded with another polymer.

In a first particular set of embodiments, the PAN contains at least or more than 50, 60, or 70 mol % acrylonitrile monomer units and up to or less than 30, 40, or 50 mol % of copolymer (i.e., non-acrylonitrile) units, provided that acrylonitrile and non-acrylonitrile portions sum to 100%. In a second particular set of embodiments, the PAN contains at least 75 mol % acrylonitrile monomer units and up to 25 mol % of copolymer units. In a third particular set of embodiments, the PAN contains at least 80 mol % acrylonitrile monomer units and up to 20 mol % of copolymer units. In a fourth particular set of embodiments, the PAN contains at least 85 mol % acrylonitrile monomer units and up to 15 mol % of copolymer units. In a fifth particular set of embodiments, the PAN contains at least 90 mol % acrylonitrile monomer units and up to 10 mol % of copolymer units.

In the method, PAN (i.e., starting PAN or precursor PAN) is mixed with an ionic liquid (IL) in which the PAN is soluble to produce a PAN composite melt in which the PAN is dissolved. Methods for producing a homogeneous mixture or solution of one component in another are well known in the art, and any such mixing method can be used herein. In some embodiments, the PAN is mixed with the ionic liquid at room temperature (typically about 15, 20, 25, or 30° C.) to provide a homogeneous PAN composite melt. In other embodiments, the PAN is mixed with the ionic liquid, and the mixture is simultaneously or subsequently heated (with or without additional mixing) to a temperature above room temperature but below the melting point or $T_g$ of PAN to yield a homogeneous PAN composite melt. The temperature employed may be, for example, 40, 50, 60, 70, 80, 90, 90, 100, 110, 120, 130, 140, 150, 160, 170, 180, 190, 200, 210, 220, 230, 240, or 250° C., or a temperature within a range bounded by any two of the foregoing values. In some embodiments, the mixing is conducted under an inert atmosphere, particularly if an elevated temperature is used. The inert atmosphere may be low oxygen (e.g., up to or less than 10, 5, 2, or 1 vol %) i.e., with at least 90 vol % inert gas (e.g., nitrogen and/or argon), or the inert atmosphere may be completely inert gas with substantially no oxygen. Any PAN:IL weight ratio can be used, provided that sufficient PAN is included to permit melt spinning from the resulting PAN composite melt. In different embodiments, the PAN:IL weight ratio is, for example, 3:1, 2.5:1, 2:1, 1.5:1, 1:1, 1:1.5, 1:2, 1:2.5, or 1:3, ora weight ratio within a range bounded by any two of the foregoing ratios (e.g., 1:1-1:3 or 1:1-1:2.5). In some embodiments, the ionic liquid is present in a greater amount by weight than the PAN in step (i).

The ionic liquid can be any ionic liquid known in the art provided that it can substantially or completely solubilize the PAN precursor being mixed with the ionic liquid. As understood in the art, an ionic liquid is a salt compound that is itself a liquid even when not dissolved in a solvent. As the ionic liquid is a salt compound, it necessarily includes a cationic component and an anionic component. The ionic liquid can be of the formula $y^+X^-$, wherein $Y^+$ is a cationic component of the ionic liquid and $X^-$ is an anionic component of the ionic liquid. The formula $(Y^+)(X^-)$ is meant to encompass a cationic component ($Y^+$) having any valency of positive charge, and an anionic component ($X^-$) having any valency of negative charge, provided that the charge contributions from the cationic and anionic portions are counterbalanced in order for charge neutrality to be preserved in the ionic liquid molecule. In some embodiments, the anion ($X^-$) of the ionic liquid is not chloride, or the anion is bromide or iodide or contains at least one bromine or iodine atom. In some embodiments, the anion ($X^-$) contains one or more nitrile groups. In some embodiments, the cationic portion ($Y^+$) of the ionic liquid contains one or more nitrile groups. In some embodiments, the anionic portion and cationic portion of the ionic liquid each contain one or more nitrile groups.

The ionic liquid is typically a liquid at room temperature (e.g., 15, 18, 20, 22, 25, or 30° C.) or lower. However, in some embodiments, the ionic liquid may become a liquid at a higher temperature than 30° C. if the process is conducted at an elevated temperature (e.g., up to 100° C.) that melts the ionic liquid. In some embodiments, the ionic liquid may have a melting point of up to or less than 100, 90, 80, 70, 60, 50, 40, or 30° C. In other embodiments, the ionic liquid is a liquid at or below 10, 5, 0, −10, −20, −30, or −40° C.

The ionic liquids considered herein preferably possess a suitable degree of thermal resilience, as typically reflected by the onset decomposition temperature, to ensure their stability for use in the applications described herein. In different embodiments, the ionic liquid preferably exhibits an onset decomposition temperature of at least 100, 150, 200, 250, 300, 350, 400, 450, 500, 525, 550, 575, or 600° C.

The ionic liquid can have any suitable purity level. In some embodiments, the ionic liquid has a purity at least or greater than 90%, 95%, 96%, 97%, 98%, 99%, 99.5%, or 99.9%. The ionic liquid is preferably substantially devoid of salt byproducts (e.g., $LiNO_3$) that are typically produced during synthesis of the ionic liquid. In some embodiments, the ionic liquid contains less than 1% by weight of salt byproducts, and more preferably, less than 0.5%, 0.1%, 0.01%, or even 0.001% by weight of salt byproducts.

The counteranion ($X^-$) of the ionic liquid is any counteranion which, when associated with the cationic component, permits the resulting ionic compound to behave as an ionic liquid. As known in the art, the composition and structure of the counteranion strongly affects the properties (e.g., melting point, volatility, stability, viscosity, hydrophobicity, and so on) of the ionic liquid. In some embodiments, the counteranion is structurally symmetrical, while in other embodiments, the counteranion is structurally asymmetrical. In some embodiments, the counteranion may include one or more nitrile groups.

In one embodiment, the counteranion of the ionic liquid is non-carbon-containing (i.e., inorganic). The inorganic counteranion may, in one embodiment, lack fluorine atoms. Some examples of such counteranions include chloride, bromide, iodide, hexachlorophosphate ($PCl_6^-$), perchlorate, chlorate, chlorite, cyanate, isocyanate, thiocyanate, isothiocyanate, perbromate, bromate, bromite, periodate, iodate, dicyanamide (i.e., $N(CN)_2^-$), tricyanamide (i.e., $N(CN)_3^-$), aluminum chlorides (e.g., $Al_2Cl_7^-$ and $AlCl_4^-$), aluminum bromides (e.g., $AlBr_4^-$), nitrate, nitrite, sulfate, sulfite, hydrogensulfate ($HSO_4^-$), also known as bisulfate), hydrogensulfite, phosphate, hydrogenphosphate ($HPO_4^{2-}$), dihydrogenphosphate ($H_2PO_4^-$), phosphite, arsenate, antimonate, selenate, tellurate, tungstate, molybdate, chromate, silicate, the borates (e.g., borate, diborate, triborate, tetraborate), anionic borane and carborane clusters (e.g., $B_{10}H_{10}^{2-}$ and $B_{12}H_{12}^{2-}$), perrhenate, permanganate, ruthenate, perruthenate, and the polyoxometallates. The inorganic counteranion may, in another embodiment, include fluorine atoms. Some examples of such counteranions include fluoride, bifluoride ($HF_2^-$), hexafluorophosphate ($PF_6^-$), fluorophosphate ($PO_3F^{2-}$), tetrafluoroborate ($BF_4^-$), aluminum fluorides (e.g., $AlF_4^-$), hexafluoroarsenate ($AsF_6^-$), and hexafluoroantimonate ($SbF_6^-$). Any one or more of the following types of inorganic counteranions (e.g., chloride) may be excluded from the ionic liquid.

In another embodiment, the counteranion of the ionic liquid is carbon-containing (i.e., organic). The organic counteranion may, in one embodiment, lack fluorine atoms. Some examples of such counteranions include carbonate, bicarbonate, the carboxylates (e.g., formate, acetate, propionate, butyrate, valerate, lactate, pyruvate, oxalate, malonate, glutarate, adipate, decanoate, salicylate, ibuprofenate, and the like), the sulfonates (e.g., $CH_3SO_3^-$, $CH_3CH_2SO_3^-$, $CH_3(CH_2)_2SO_3^-$, benzenesulfonate, toluenesulfonate, dodecylbenzenesulfonate, docusate, and the like), the alkoxides (e.g., methoxide, ethoxide, isopropoxide, phenoxide, and glycolate), the amides (e.g., dimethylamide and diisopropylamide), diketonates (e.g., acetylacetonate), the organoborates (e.g., $BR_1R_2R_3R_4^-$, wherein $R_1$, $R_2$, $R_3$, $R_4$ are typically hydrocarbon groups containing 1 to 6 carbon atoms), the alkyl sulfates (e.g., diethyl sulfate), alkylphosphates (e.g., ethylphosphate or diethylphosphate), and the phosphinates (e.g., bis-(2,4,4-trimethylpentyl)phosphinate). The organic counteranion may, in another embodiment, include fluorine atoms. Some examples of such counteranions include the fluorosulfonates (e.g., $CF_3SO_3^-$, $CF_3CF_2SO_3^-$, $CF_3(CF_2)_2SO_3^-$, $CHF_2CF_2SO_3^-$, and the like), the fluoroalkoxides (e.g., $CF_3O^-$, $CF_3CH_2O^-$, $CF_3CF_2O^-$, and pentafluorophenolate), the fluorocarboxylates (e.g., trifluoroacetate and pentafluoropropionate), and the fluorosulfonylimidies (e.g., $(CF_3SO_2)_2N^-$). In some embodiments, the anion includes at least one nitrile group. In some embodiments, any one or more of the foregoing organic counteranions may be excluded from the ionic liquid.

In particular embodiments, chloride is excluded as a counteranion in the ionic liquid. In other embodiments, the anion of the ionic liquid is bromide ($Br^-$), wherein "bromide" may or may not also include tribromide ($Br_3^-$). The anion may also be an anion that includes one or more bromine atoms in combination with one or more other elements, an example of which is bromate ($BrO_3^-$). Similarly, the anion of the ionic liquid may be iodide ($I^-$), wherein "iodide" may or may not also include triiodide ($I_3^-$). The anion may also be an anion that includes one or more iodine atoms in combination with one or more other elements, an example of which is iodate ($IO_3^-$) or periodate (e.g., $IO_4^-$). In some embodiments, the anion of the ionic liquid is selected from bromide, iodide, carboxylate, sulfate, bisulfate, sulfite, bisulfite, sulfonates, carboxylates, dicyanamide, tricyanamide, sulfonimides, phosphinates, and perchlorate. Any of the various types of cations described in this disclosure can be combined with any one of the anions described anywhere in this disclosure provided it results in an ionic liquid capable of dissolving PAN. Moreover, for any cation described in this disclosure, any one or more counteranions described in this disclosure may be excluded.

In some embodiments, the cation of the ionic liquid contains at least one nitrogen atom. A cation containing at least one nitrogen atom may be, for example, an ammonium cation. In a first embodiment, the ammonium cation includes at least one ring containing at least one ring nitrogen atom, in which case the ring is understood to be a heterocyclic ring. Typically, one or more ring nitrogen atoms hold a portion or all of the positive charge in the ring. The heterocyclic ring having a positively-charged ring nitrogen atom can be monocyclic, bicyclic, tricyclic, or a higher cyclic (polycyclic) ring system. Some examples of a heterocyclic ring having a positively-charged ring nitrogen atom include imidazolium, pyridinium, pyrazinium, pyrrolidinium, piperidinium, piperazinium, morpholinium, pyrrolium, pyrazolium, pyrimidinium, triazolium, oxazolium, thiazolium, triazinium, and cyclic guanidinium rings. Any of the foregoing cationic rings may or may not be bound or fused with one or more other saturated or unsaturated (e.g., aromatic) rings, such as a benzene, cyclohexane, cyclohexene, pyridine, pyrazine, pyrrolidine, piperidine, piperazine, pyrrole, pyrazole, pyrimidine, or indole rings. Some examples of fused charged rings include benzimidazolium, pyrrolo[1,2-a]pyrimidinium, indolium, quinolinium, quinazolinium, quinoxalinium, 5,6,7,8-tetrahydroimidazo[1,2-a]pyridine, and H-imidazo[1,2-a]pyridine. Any of the foregoing cationic rings may be substituted by one or more hydrocarbon groups (R) as further described below. Typically, at least one ring nitrogen atom is substituted with a hydrocarbon group (R) to provide the positive charge. Ionic liquids containing any of the foregoing cationic components are either commercially available or can be synthesized by procedures well-known in the art, as evidenced by, for example, $T_m$ L. Greaves, et al., "Protic Ionic Liquids: Properties and Applications", *Chem. Rev.,* 108, pp. 206-237 (2008), the contents of which are herein incorporated by reference in their entirety. Any of the ionic liquids described in the foregoing reference may be used herein.

In one embodiment, the cation of the ionic liquid is or contains an imidazolium ring. The resulting imidazolium-based ionic liquid may have a structure of the general formula:

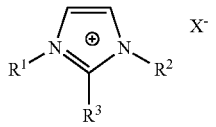

(1)

In Formula (1) above, $R^1$ and $R^2$ are each independently a saturated or unsaturated, straight-chained, branched, or cyclic hydrocarbon group (R), as further described below, having at least one carbon atom. $R^3$ is selected from hydrogen atom and R. In some embodiments, $R^1$ and $R^2$, or $R^1$ and $R^3$, or $R^1$ and $R^3$ are different in structure or number of carbon atoms, whereas in other embodiments, $R^1$ and $R^2$, or $R^1$ and $R^3$, or $R^2$ and $R^3$ are the same either in structure or number of carbon atoms. In different embodiments, $R^1$ and $R^2$ (or $R^1$, $R^2$ and $R^3$) each independently have a minimum of at least one, two, three, four, five, six, seven, or eight carbon atoms. In other embodiments, $R^1$ and $R^2$ (or $R^1$, $R^2$ and $R^3$) each independently have a maximum of two, three, four, five, six, seven, eight, nine, ten, eleven, twelve, thirteen, fourteen, fifteen, sixteen, seventeen, or eighteen carbon atoms. In other embodiments, $R^1$ and $R^2$ (or $R^1$, $R^2$ and $R^3$) independently have a number of carbon atoms within a range of carbon atoms bounded by any of the exemplary minimum and maximum carbon numbers provided above (e.g., 1-18, 1-16, 1-12, 1-10, 1-8, 1-6, or 1-4 carbon atoms). As the double bonds shown in Formula (1) are generally delocalized, other structurally equivalent depictions may be possible for the imidazolium ring.

The counteranion ($X^-$) in Formula (1) can be any counteranion, such as those described above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, the imidazolium portion of the ionic liquid contains one or more nitrile (CN) groups. In particular embodiments, the one or more nitrile groups are included as a substituent in $R^1$, $R^2$ and/or $R^3$, when any of the foregoing groups is a saturated or unsaturated, straight-chained, branched, or cyclic hydrocarbon group (R). In further embodiments, $R^1$, $R^2$ and/or $R^3$ contains a nitrile group at the terminus of a straight-chained or branched alkyl group, wherein the nitrile-containing group can be depicted by the following formula: —$(CH_2)_n$CN, wherein n may be 1-18 or sub-range therein (e.g., 1-12, 1-10, 1-8, 1-6, 1-4, or 1-3), and wherein an H atom of one or more methylene linkers may be substituted by a methyl or ethyl group. Any one or more of $R^1$, $R^2$ and/or $R^3$ may have the formula —$(CH_2)_n$CN. In some embodiments, the anionic portion and imidazolium portion of the ionic liquid each contain one or more nitrile groups.

In a first embodiment, one, two, or all of $R^1$, $R^2$ and $R^3$ are saturated and straight-chained hydrocarbon groups (i.e., straight-chained alkyl groups). Some examples of straight-chained alkyl groups include methyl, ethyl, n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, and n-octadecyl groups.

In a second embodiment, one, two, or all of $R^1$, $R^2$ and $R^3$ are saturated and branched hydrocarbon groups (i.e., branched alkyl groups). Some examples of branched alkyl groups include isopropyl, isobutyl, sec-butyl, t-butyl, isopentyl, neopentyl, 2-methylpentyl, 3-methylpentyl, and the numerous $C_7$, $C_8$, $C_9$, $C_{10}$, $C_{11}$, $C_{12}$, $C_{13}$, $C_{14}$, $C_{15}$, $C_{16}$, $C_{17}$, and $C_{18}$ saturated and branched hydrocarbon groups.

In a third embodiment, one, two, or all of $R^1$, $R^2$ and $R^3$ are saturated and cyclic hydrocarbon groups (i.e., cycloalkyl groups). Some examples of cycloalkyl groups include cyclopropyl, cyclobutyl, cyclopentyl, cyclohexyl, cycloheptyl, cyclooctyl, and their methyl-, ethyl-, and propyl-substituted derivatives and/or their methylene, dimethylene, trimethylene, and tetramethylene cross-linked derivatives (as cross-linked to a nitrogen atom of the imidazolium ring). The cycloalkyl group can also be a polycyclic (e.g., bicyclic or tricyclic) group by either possessing a bond between two of the ring groups (e.g., dicyclohexyl) or a shared (i.e., fused) side (e.g., decalin and norbornane).

In a fourth embodiment, one, two, or all of $R^1$, $R^2$ and $R^3$ are unsaturated and straight-chained hydrocarbon groups (e.g., straight-chained olefinic or alkenyl groups). Some examples of straight-chained olefinic groups include vinyl, 2-propen-1-yl, 3-buten-1-yl, 2-buten-1-yl, butadienyl, 4-penten-1-yl, 3-penten-1-yl, 2-penten-1-yl, 2,4-pentadien-1-yl, 5-hexen-1-yl, 4-hexen-1-yl, 3-hexen-1-yl, 3,5-hexadien-1-yl, 1,3,5-hexatrien-1-yl, 6-hepten-1-yl, ethynyl, propargyl, and the numerous $C_7$, $C_8$, $C_9$, $C_{10}$, $C_{11}$, $C_{12}$, $C_{13}$, $C_{14}$, $C_{15}$, $C_{16}$, $C_{17}$, and $C_{18}$ unsaturated and straight-chained hydrocarbon groups.

In a fifth embodiment, one, two, or all of $R^1$, $R^2$ and $R^3$ are unsaturated and branched hydrocarbon groups (i.e., branched olefinic or alkenyl groups). Some branched olefinic groups include 2-propen-2-yl, 3-buten-2-yl, 3-buten-3-yl, 4-penten-2-yl, 4-penten-3-yl, 3-penten-2-yl, 3-penten-3-yl, 2,4-pentadien-3-yl, and the numerous $C_6$, $C_7$, $C_8$, $C_9$, $C_{10}$, $C_{11}$, $C_{12}$, $C_{13}$, $C_{14}$, $C_{15}$, $C_{16}$, $C_{17}$, and $C_{18}$ unsaturated and branched hydrocarbon groups.

In a sixth embodiment, one, two, or all of $R^1$, $R^2$ and $R^3$ are unsaturated and cyclic hydrocarbon groups. Some examples of unsaturated and cyclic hydrocarbon groups include cyclopropenyl, cyclobutenyl, cyclopentenyl, cyclopentadienyl, cyclohexenyl, cyclohexadienyl, phenyl, benzyl, cycloheptenyl, cycloheptadienyl, cyclooctenyl, cyclooctadienyl, cyclooctatetraenyl, and their methyl-, ethyl-, and propyl-substituted derivatives and/or their methylene, dimethylene, trimethylene, and tetramethylene cross-linked derivatives (as crosslinked to a nitrogen atom of the imidazolium ring). The unsaturated cyclic hydrocarbon group can also be a polycyclic (e.g., bicyclic or tricyclic) group by either possessing a bond between two of the ring groups (e.g., biphenyl) or a shared (i.e., fused) side (e.g., naphthalene, anthracene, and phenanthrene).

In one embodiment, as in the examples above, one or more of the hydrocarbon groups (R), described above, are composed solely of carbon and hydrogen, i.e., do not include one or more heteroatoms, such as oxygen or nitrogen atoms. In another embodiment, one or more of the hydrocarbon groups include one or more heteroatoms, such as one or more oxygen, nitrogen, sulfur, and/or fluorine atoms. Some examples of oxygen-containing hydrocarbon groups include those possessing one or more hydroxyl (OH) groups, alkoxide (—OR), carbonyl groups (e.g., ketone, ester, amide, or urea functionalities), amino (e.g., $—NH_2$, —NHR, and $—NR_2$), imino (e.g., ═N—, ═N—H or ═N—R groups), carbon-oxygen-carbon (ether) groups, and/or nitrile (CN) groups. In some embodiments, the oxygen-containing hydrocarbon group includes two or more ether groups, such as a polyalkyleneoxide group, such as a polyethyleneoxide group. Some examples of nitrogen-containing hydrocarbon groups include those possessing one or more primary amine groups, secondary amine groups, tertiary amine groups, and/or quaternary amine groups, wherein it is understood that a quaternary amine group necessarily possesses a positive charge and requires a counteranion. Some examples of fluorine-containing hydrocarbon groups (i.e., fluorocarbon groups) include the partially-substituted varieties (e.g., fluoromethyl, difluoromethyl, 2-fluoroethyl, 2,2-difluoroethyl, 2,2,2-trifluoroethyl, and the like) and perfluoro-substituted varieties (e.g., perfluoromethyl, perfluoroethyl, perfluoropropyl, perfluorobutyl, and the like). In some embodiments, any one or more of the foregoing exemplary heteroatoms or heteroatom-containing substituents may be excluded from Formula (1) or from any of the cationic and/or anionic portions of the ionic liquids described herein.

The ionic liquids according to Formula (1) can contain any of the above-described imidazolium-based cationic components associated (i.e., complexed) with any of the counteranions ($X^-$) described above. Some general examples of imidazolium-based ionic liquids according to Formula (1) include 1,3-dimethylimidazolium$^+X^-$, 1,2,3-trimethylimidazolium$^+X^-$, 2-ethyl-1,3-dimethylimidazolium$^+X^-$, 2-n-propyl-1,3-dimethylimidazolium$^+X^-$, 2-n-butyl-1,3-dimethylimidazolium$^+X^-$, 1-ethyl-2,3-dimethylimidazolium$^+X^-$, 1-n-propyl-2,3-dimethylimidazolium$^+X^-$, 1-n-butyl-2,3-dimethylimidazolium$^+X^-$, 1-methyl-3-ethylimidazolium$^+X^-$, 1-methyl-3-n-propylimidazolium$^+X^-$, 1-methyl-3-isopropylimidazolium$^+X^-$, 1-methyl-3-n-butylimidazolium$^+X^-$ (i.e., BMIM$^+X^-$), 1-methyl-3-isobutylimidazolium$^+X^-$, 1-methyl-3-sec-butylimidazolium$^+X^-$, 1-methyl-3-t-butylimidazolium$^+X^-$, 1,3-diethylimidazolium$^+X^-$, 1-ethyl-3-n-propylimidazolium$^+X^-$, 1-ethyl-3-isopropylimidazolium$^+X^-$, 1-ethyl-3-n-butylimidazolium$^+X^-$, 1-ethyl-3-isobutylimidazolium$^+X^-$, 1-ethyl-3-sec-butylimidazolium$^+X^-$, 1-ethyl-3-t-butylimidazolium$^+X^-$, 1,3-di-n-propylimidazolium$^+X^-$, 1-n-propyl-3-isopropylimidazolium$^+X^-$, 1-n-propyl-3-n-butylimidazolium$^+X^-$, 1-n-propyl-3-isobutylimidazolium$^+X^-$, 1-n-propyl-3-sec-butylimidazolium$^+X^-$, 1-n-propyl-3-t-butylimidazolium$^+X^-$, 1,3-di-isopropylimidazolium$^+X^-$, 1-isopropyl-3-n-butylimidazolium$^+X^-$, 1-isopropyl-3-isobutylimidazolium$^+X^-$, 1-isopropyl-3-sec-butylimidazolium$^+X^-$, 1-isopropyl-3-t-butylimidazolium$^+X^-$, 1,3-di-n-butylimidazolium$^+X^-$, 1-n-butyl-3-isobutylimidazolium$^+X^-$, 1-n-butyl-3-sec-butylimidazolium$^+X^-$, 1-n-butyl-3-t-butylimidazolium$^+X^-$, 1,3-di-isobutylimidazolium$^+X^-$, 1-isobutyl-3-sec-butylimidazolium$^+X^-$, 1-isobutyl-3-t-butylimidazolium$^+X^-$, 1,3-di-sec-butylimidazolium$^+X^-$, 1-sec-butyl-3-t-butylimidazolium$^+X^-$, 1,3-di-t-butylimidazolium$^+X^-$, 1-methyl-3-pentylimidazolium$^+X^-$, 1-methyl-3-hexylimidazolium$^+X^-$, 1-methyl-3-heptylimidazolium$^+X^-$, 1-methyl-3-octylimidazolium$^+X^-$, 1-methyl-3-decylimidazolium$^+X^-$, 1-methyl-3-dodecylimidazolium$^+X^-$, 1-methyl-3-tetradecylimidazolium$^+$1-methyl-3-hexadecylimidazolium$^+X^-$, 1-methyl-3-octadecylimidazolium$^+X^-$, 1-(2-hydroxyethyl)-3-methylimidazolium$^+X^-$, and 1-allyl-3-methylimidazolium$^+X^-$. The counteranion ($X^-$) can be any counteranion, such as any of those described earlier above. In some embodiments, the anion (X) of the ionic liquid is not chloride, or the anion is bromide or iodide or contains at least one bromine or iodine atom. In some embodiments, the anion ($X^-$) contains at least one nitrile group.

In Formula (1), one or both of the hydrogen atoms at the 4- and 5-positions in Formula (1) may also be substituted with a group, such as a hydrocarbon group, such as any of the hydrocarbon groups described above, an alkoxide group (—OR), hydroxy group (OH), amino group ($—NH_2$, —NHR, or $—NR_2$), carboxamide group ($—C(O)NR_2$ wherein one or both R groups can be replaced with H), nitrile group, and/or halogen atom (e.g., F, Cl, Br, or I atom), wherein the R groups may be the same or different and may or may not be interconnected to form a ring. For example, one or both of the 4- and 5-positions of the imidazole ring may be substituted with a methyl, ethyl, n-propyl, isopropyl, n-butyl, isobutyl, sec-butyl, or t-butyl group. $R^3$ at the 2-position may also be selected from any of the foregoing groups provided for the 4- and 5-positions. Moreover, any one or more of $R^1$, $R^2$ and $R^3$ may or may not also include an imidazole or imidazolium ring, which therefore may result in a bi-imidazolium, tri-imidazolium, or tetra-imidazolium cationic portion. In some embodiments, the 4- and/or 5-positions may be substituted with a nitrile (CN) group or a hydrocarbon group (R) substituted with a nitrile group, such as a $—(CH_2)_nCN$ group, as described above.

In some embodiments of Formula (1), $R^1$ and $R^3$, or $R^2$ and $R^3$ are interconnected, thereby forming an imidazolyl-containing bicyclic ring system. The interconnection can be saturated or unsaturated, and may or may not include substituting groups, as described above for the hydrocarbon groups R provided above. Some examples of ionic liquids containing such imidazolyl-containing bicyclic ring systems include those according to the following formulas:

(1a)

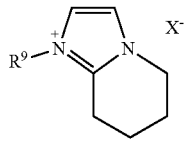

(1b)

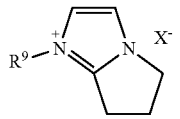

In Formulas (1a) and (1b), $R^9$ and $R^{10}$ independently represent a hydrocarbon group, with or without heteroatom substitution, such as any of the hydrocarbon groups (R) described above for $R^1$, $R^2$ and $R^3$ of Formula (1). In some embodiments, $R^9$ and $R^{10}$ are independently selected from methyl, ethyl, n-propyl, isopropyl, n-butyl, isobutyl, sec-butyl, t-butyl, n-pentyl, isopentyl, neopentyl, n-hexyl, isohexyl, vinyl, and allyl groups. Any of the hydrogen atoms at available carbon atoms in Formulas (1a) and (1b) may be substituted with a group, such as a hydrocarbon group, such as any of the hydrocarbon groups (R) described above, an alkoxide group (—OR), hydroxy group (OH), amino group (—$NH_2$, —NHR, or —$NR_2$), carboxamide group (—C(O)$NR_2$ wherein one or both R groups can be replaced with H), nitrile group, and/or halogen atom (e.g., F, Cl, Br, or I atom), wherein the R groups may be the same or different and may or may not be interconnected to form a ring. The counteranion ($X^-$) can be any counteranion, such as any of those described earlier above. In some embodiments, the anion (X) of the ionic liquid is not chloride, or the anion is bromide or iodide or contains at least one bromine or iodine atom. In some embodiments, the anion ($X^-$) contains at least one nitrile group. In some embodiments, any of the imidazolyl-containing bicyclic ring systems contain (e.g., in $R^9$ and/or $R^{10}$) one or more nitrile groups or one or more groups of the formula —$(CH_2)_nCN$ as described earlier above.

In another embodiment, the ammonium ionic liquid is an N-hydrocarbylpyridinium-based ionic liquid having a structure of the general formula:

(2)

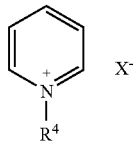

In Formula (2), $R^4$ represents a hydrocarbon group, with or without heteroatom substitution, such as any of the hydrocarbon groups (R) described above for $R^1$, $R^2$ and $R^3$ of Formula (1). Some general examples of N-alkylpyridinium-based ionic liquids include N-methylpyridinium$^+X^-$, N-ethylpyridinium$^+X^-$, N-n-propylpyridinium$^+X^-$, N-isopropylpyridinium$^+X^-$, N-n-butylpyridinium$^+X^-$, N-isobutylpyridinium$^+X^-$, N-sec-butylpyridinium$^+X^-$, N-t-butylpyridinium$^+X^-$, N-n-pentylpyridinium$^+X^-$, N-isopentylpyridinium$^+X^-$, N-neopentylpyridinium$^+X^-$, N-n-hexylpyridinium$^+X^-$, N-n-heptylpyridinium$^+X^-$, N-n-octylpyridinium$^+X^-$, N-n-nonylpyridinium$^+X^-$, N-n-decylpyridinium$^+X^-$, N-n-undecylpyridinium$^+X^-$, N-n-dodecylpyridinium$^+X^-$, N-n-tridecylpyridinium$^+X^-$, N-n-tetradecylpyridinium$^+X^-$, N-n-pentadecylpyridinium$^+X^-$, N-n-hexadecylpyridinium$^+X^-$, N-n-heptadecylpyridinium$^+X^-$, N-n-octadecylpyridinium$^+X^-$, N-vinylpyridinium$^+X^-$, N-allylpyridinium$^+X^-$, N-phenylpyridinium$^+X^-$, N-(2-hydroxyethyl)pyridinium$^+X^-$, N-benzylpyridinium$^+X^-$, and N-phenethylpyridinium$^+X^-$. The counteranion ($X^-$) in Formula (2) can be any counteranion, such as any of those described earlier above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, any of the pyridinium portions described above contain (e.g., in $R^4$) one or more nitrile groups or one or more groups of the formula —$(CH_2)_nCN$ as described earlier above.

In Formula (2), any one or more of the hydrogen atoms on the ring carbon atoms can be substituted with one or more other groups, such as a hydrocarbon group (R), alkoxide group (—OR), hydroxy group (OH), amino group (—$NH_2$, —NHR, or —$NR_2$), carboxamide group (—C(O)$NR_2$ wherein one or both R groups can be replaced with H), nitrile group, and/or halogen atom (e.g., F, Cl, Br, or I atom), wherein the R groups may be the same or different and may or may not be interconnected to form a ring. Some examples of such ionic liquids include N-methyl-4-methylpyridinium $X^-$, N-ethyl-4-methylpyridinium $X^-$, N-methyl-4-ethylpyridinium $X^-$, N-methyl-4-isopropylpyridinium $X^-$, N-isopropyl-4-methylpyridinium $X^-$. Moreover, any one or two of the ring carbon atoms ortho, meta, or para to the shown ring nitrogen atom in the pyridinium ring may be replaced with a respective number of ring nitrogen atoms, which may be neutral or positively charged ring nitrogen atoms.

In another embodiment, the ammonium ionic liquid is a quaternary ammonium ionic liquid having a structure of the general formula:

(3)

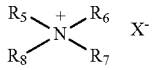

In Formula (3), $R^5$, $R^6$, $R^7$, and $R^8$ independently represent a hydrocarbon group, with or without heteroatom substitution, such as any of the hydrocarbon groups (R) described above for $R^1$, $R^2$ and $R^3$ of Formula (1), or a hydrogen atom, wherein at least one of $R^5$, $R^6$, $R^7$, and $R^8$ represents a hydrocarbon group (with or without heteroatom substitution). In one embodiment, one of $R^5$, $R^6$, $R^7$, and $R^8$ is a hydrocarbon group while the rest are hydrogen atoms. In another embodiment, two of $R^5$, $R^6$, $R^7$, and $R^8$ are hydrocarbon groups while two are hydrogen atoms. In another embodiment, three of $R^5$, $R^6$, $R^7$, and $R^8$ are hydrocarbon groups while one is a hydrogen atom. In another embodiment, all of $R^5$, $R^6$, $R^7$, and $R^8$ are hydrocarbon groups (or more specifically, alkyl groups), thereby resulting in a tetrahydrocarbylammonium group (or more specifically, a tetraalkylammonium group). Some general examples of quaternary ammonium ionic liquids include methylammonium$^+X^-$, dimethylammonium$^+X^-$, trimethylammonium$^+X^-$, tetramethylammonium$^+X^-$, ethylammonium$^+X^-$, ethyltrimethylammonium$^+X^-$, diethylammonium$^+X^-$, triethylammonium$^+X^-$, tetraethylammonium$^+X^-$, n-propylammonium$^+X^-$, n-propyltrimethylammonium$^+X^-$, isopropylammonium$^+X^-$, n-butylammonium$^+X^-$, n-butyltrimethylammonium$^+X^-$, n-butylmethylammonium$^+X^-$, di-(n-butyl)dimethylammonium$^+X^-$, tri-(n-butyl)methylammonium$^+X^-$, n-pentylammonium$^+X^-$, n-pentyltrimethylammonium$^+X^-$, tri-(n-pentyl)methylammonium$^+X^-$, n-hexylammonium$^+$ n-hexyltrimethylammonium$^+X^-$, tri-(n-hexyl)methylammonium$^+X^-$, n-heptylammonium$^+X^-$, n-heptyltrimethylammonium$^+X^-$; tri-(n-heptyl)methylammonium$^+X^-$, n-octylammonium$^+X^-$, n-octyltrimethylammonium$^+X^-$, tri-(n-octyl)methylammonium$^+X^-$, benzyltrimethylammonium$^+X^-$ choline$^+X^{-1}$, 2-hydroxyethylammonium$^+X^-$, allylammonium$^+X^-$, allyltrimethylammonium$^+X^-$, [(2-methacryloxy)ethyl]-trimethylammonium$^+X^-$, and (4-vinylbenzyl)trimethylammonium$^+X^-$. The counteranion ($X^-$) in Formula (3) can be any counteranion, such as any of those described earlier above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, any of the quaternary ammonium portions described above contain (e.g., in $R^5$, $R^6$, $R^7$, and/or $R^8$) one or more nitrile groups or one or more groups of the formula —$(CH_2)_nCN$ as described earlier above.

In another embodiment, the ammonium ionic liquid is a cyclic guanidinium-based ionic liquid. The cyclic guanidinium-based ionic liquid can have any of the structures known in the art, including those described in U.S. Pat. No. 8,129,543 and M. G. Bogdanov, et al., *Z. Naturforsch,* 65b, pp. 37-48, 2010, the contents of which are herein incorporated by reference in their entirety.

The cyclic guanidinium-based ionic liquid can be described by the following general formula:

(4)

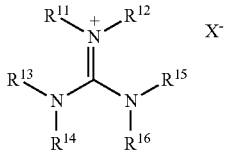

In Formula (4) above, $R^{11}$, $R^{12}$, $R^{13}$, $R^{14}$, $R^{15}$, and/or $R^{16}$ groups independently represent a hydrocarbon group, with or without heteroatom substitution, such as any of the hydrocarbon groups (R) described above for $R^1$, $R^2$ and $R^3$ of Formula (1), or a hydrogen atom, provided that at least two of $R^{11}$, $R^{12}$, $R^{13}$, $R^{14}$, $R^{15}$, and $R^{16}$ are interconnected to form a ring or a bicyclic, tricyclic, or higher cyclic ring system. In some embodiments, $R^{11}$, $R^{12}$, $R^{13}$, $R^{14}$, $R^{15}$, and/or $R^{16}$ groups are independently selected from methyl, ethyl, n-propyl, isopropyl, n-butyl, isobutyl, sec-butyl, t-butyl, n-pentyl, isopentyl, neopentyl, n-hexyl, isohexyl, vinyl, and allyl groups, provided that at least two of $R^{11}$, $R^{12}$, $R^{13}$, $R^{14}$, $R^{15}$, and $R^{16}$ are interconnected to form a ring or a bicyclic, tricyclic, or higher cyclic ring system. In a first set of embodiments, $R^{11}$ and $R^{12}$ are interconnected. In a second set of embodiments, $R^{13}$ and $R^{14}$, or $R^{15}$ and $R^{16}$, are interconnected. In a third set of embodiments, $R^{11}$ and $R^{13}$, or $R^{12}$ and $R^{15}$, are interconnected. In a fourth set of embodiments, $R^{14}$ and $R^{16}$ are interconnected. In other embodiments, any two or three of the foregoing types of interconnections are combined. The foregoing embodiments also include the possibility that all of $R^{11}$, $R^{12}$, $R^{13}$, $R^{14}$, $R^{15}$, and $R^{16}$ groups are engaged in an interconnection. The counteranion ($X^-$) in Formula (4) can be any counteranion, such as any of those described earlier above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, any of the cyclic guanidinium portions described above contain (e.g., in $R^{11}$, $R^{12}$, $R^{13}$, $R^{14}$, $R^{15}$, $R^{16}$) one or more nitrile groups or one or more groups of the formula $—(CH_2)_nCN$ as described earlier above.

In particular embodiments, the cyclic guanidinium-based ionic liquid has a structure of any of the following general formulas:

(4a)

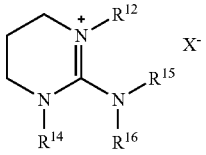

(4b)

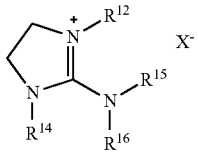

-continued (4c)

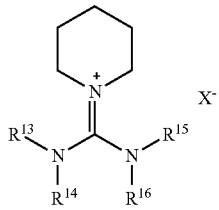

(4d)

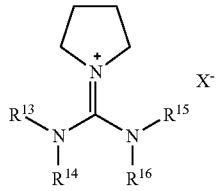

(4e)

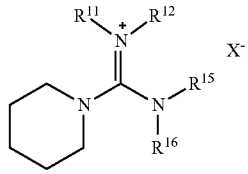

(4f)

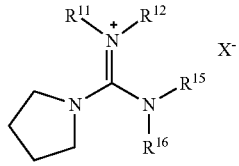

(4g)

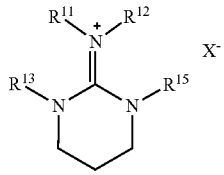

(4h)

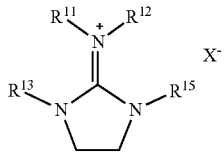

(4i)

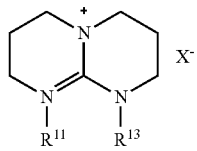

(4j)

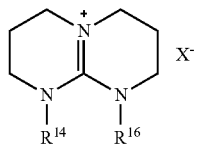

-continued (4k)

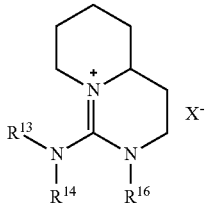

(4l)

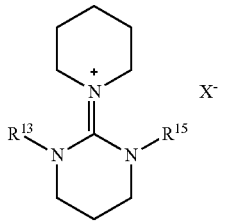

(4m)

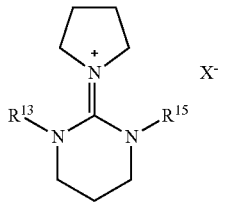

(4n)

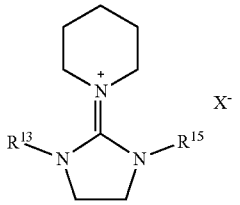

(4p)

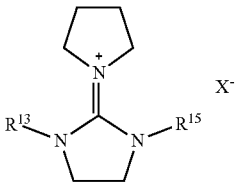

(4q)

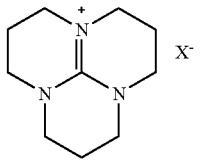

In some embodiments, any of the cyclic guanidinium structures shown in Formulas (4a)-(4q) may have a ring carbon atom replaced with a heteroatom selected from oxygen (O), sulfur (S), and/or nitrogen (—NR—). Moreover, any of the hydrogen atoms residing on ring carbon atoms may be substituted with one or more other groups, such as a hydrocarbon group (R), alkoxide group (—OR), hydroxy group (OH), amino group (—$NH_2$, —NHR, or —$NR_2$), carboxamide group (—C(O)$NR_2$ wherein one or both R groups can be replaced with H), nitrile group, and/or halogen atom (e.g., F, Cl, Br, or I atom), wherein the R groups may be the same or different and may or may not be interconnected to form a ring.

In another embodiment, the ammonium ionic liquid is a piperidinium-based ionic liquid having a structure of the following general formula:

(5)

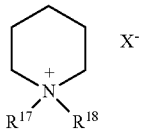

In Formula (5), $R^{17}$ and $R^{18}$ independently represent a hydrocarbon group, with or without heteroatom substitution, such as any of the hydrocarbon groups (R) described above for $R^1$, $R^2$ and $R^3$ of Formula (1). Some examples of piperidinium-based ionic liquids include 1, 1-dimethylpiperidinium$^+X^-$, 1-methyl-1-ethylpiperidinium$^+X^-$, 1-methyl-1-propylpiperidinium$^+X^-$, 1-methyl-1-butylpiperidinium$^+X^-$, 1-methyl-1-isobutylpiperidinium$^+X^-$, 1-methyl-1-pentylpiperidinium$^+X^-$, 1-methyl-1-hexylpiperidinium$^+X^-$, 1-methyl-1-heptylpiperidinium$^+X^-$, 1-methyl-1-octylpiperidinium$^+X^-$, 1-methyl-1-decylpiperidinium$^+X^-$, 1-methyl-1-dodecylpiperidinium$^+X^-$, 1-methyl-1-tetradecylpiperidinium$^+X^-$, 1-methyl-1-hexadecylpiperidinium$^+X^-$, 1-methyl-1-octadecylpiperidinium$^+X^-$, 1,1-diethylpiperidinium$^+X^-$, 1,1-dipropylpiperidinium$^+X^-$, 1,1-dibutylpiperidinium$^+X^-$, and 1,1-diisobutylpiperidinium$^+X^-$. In some embodiments, the piperidinium ring shown in Formula (5) may have a ring carbon atom replaced with a heteroatom selected from oxygen (O), sulfur (S), and/or nitrogen (—NR—). Moreover, any of the hydrogen atoms residing on ring carbon atoms may be substituted with one or more other groups, such as a hydrocarbon group (R), alkoxide group (—OR), hydroxy group (OH), amino group (—$NH_2$, —NHR, or —$NR_2$), carboxamide group (—C(O)$NR_2$ wherein one or both R groups can be replaced with H), nitrile group, and/or halogen atom (e.g., F, Cl, Br, or I atom), wherein the R groups may be the same or different and may or may not be interconnected to form a ring. The counteranion ($X^-$) of Formula (5) can be any counteranion, such as any of those described earlier above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, any of the piperidinium portions described above contain (e.g., in $R^{17}$ and/or $R^{18}$) one or more nitrile groups or one or more groups of the formula —$(CH_2)_nCN$ as described earlier above.

In another embodiment, the ammonium ionic liquid is a pyrrolidinium-based ionic liquid having a structure of the following general formula:

(6)

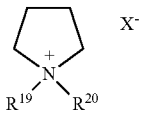

In Formula (6), $R^{19}$ and $R^{20}$ independently represent a hydrocarbon group, with or without heteroatom substitution, such as any of the hydrocarbon groups (R) described above for $R^1$, $R^2$ and $R^3$ of Formula (1). Some examples of pyrrolidinium-based ionic liquids include 1,1-dimethylpyrrolidinium$^+X^-$, 1-methyl-1-ethylpyrrolidinium$^+X^-$, 1-methyl-1-propylpyrrolidinium$^+X^-$, 1-methyl-1-butylpyrrolidinium$^+X^-$, 1-methyl-1-isobutylpyrrolidinium$^+X^-$, 1-methyl-1-pentylpyrrolidinium$^+X^-$, 1-methyl-1-hexylpyrrolidinium$^+X^-$, 1-methyl-1-heptylpyrrolidinium$^+X^-$, 1-methyl-1-octylpyrrolidinium$^+X^-$, 1-methyl-1-decylpyrrolidinium$^+X^-$, 1-methyl-1-dodecylpyrrolidinium$^+X^-$, 1-methyl-1-tetradecylpyrrolidinium$^+X^-$, 1-methyl-1-hexadecylpyrrolidinium$^+X^-$, 1-methyl-1-octadecylpyrrolidinium$^+X^-$, 1,1-diethylpyrrolidinium$^+X^-$, 1,1-dipropylpyrrolidinium$^+X^-$, 1,1-dibutylpyrrolidinium$^+X^-$, and 1,1-diisobutylpyrrolidinium$^+X^-$. In some embodiments, the pyrrolidinium ring shown in Formula (6) may have a ring carbon atom replaced with a heteroatom selected from oxygen (O), sulfur (S), and/or nitrogen (—NR—). Moreover, any of the hydrogen atoms residing on ring carbon atoms may be substituted with one or more other groups, such as a hydrocarbon group (R), alkoxide group (—OR), hydroxy group (OH), amino group (—$NH_2$, —NHR, or —$NR_2$), carboxamide group (—C(O)$NR_2$ wherein one or both R groups can be replaced with H), nitrile group, and/or halogen atom (e.g., F, Cl, Br, or I atom), wherein the R groups may be the same or different and may or may not be interconnected to form a ring. The counteranion ($X^-$) in Formula (6) can be any counteranion, such as any of those described earlier above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, any of the pyrrolidinium portions described above contain (e.g., in $R^{19}$ and/or $R^{20}$) one or more nitrile groups or one or more groups of the formula —$(CH_2)_n$CN as described earlier above.

In other aspects, the ionic liquid is a phosphonium-based ionic liquid. The phosphonium-based ionic liquid can have a structure of the following general formula:

(7)

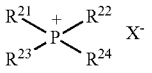

In Formula (7), $R^{21}$, $R^{22}$, $R^{23}$, and $R^{24}$ independently represent a hydrocarbon group, with or without heteroatom substitution, such as any of the hydrocarbon groups (R) described above for $R^1$, $R^2$ and $R^3$ of Formula (1). Some general examples of phosphonium-based ionic liquids include tetramethylphosphonium$^+X^-$, tetraethylphosphonium$^+X^-$, tetrapropylphosphonium$^+X^-$, tetrabutylphosphonium$^+X^-$, tetrapentylphosphonium$^+X^-$, tetrahexylphosphonium$^+X^-$, tetraheptylphosphonium$^+X^-$, tetraoctylphosphonium$^+X^-$, tetranonylphosphonium$^+X^-$, tetradecylphosphonium$^+X^-$, tetraphenylphosphonium$^+X^-$, tetrabenzylphosphonium$^+X^-$, ethyltrimethylphosphonium$^+X^-$, n-propyltrimethylphosphonium$^+X^-$, butyltrimethylphosphonium$^+X^-$, dibutyldimethylphosphonium$^+X^-$, tributylmethylphosphonium$^+X^-$, butyltriethylphosphonium$^+X^-$, dibutyldiethylphosphonium$^+X^-$, tributylethylphosphonium$^+X^-$, triisobutylmethylphosphonium$^+X^-$, tributylhexylphosphonium$^+X^-$, tributylheptylphosphonium$^+X^-$, tributyloctylphosphonium$^+X^-$, tributyldecylphosphonium$^+X^-$, tributyldodecylphosphonium$^+X^-$, tributyltetradecylphosphonium$^+X^-$, tributylhexadecylphosphonium$^+X^-$, hexyltrimethylphosphonium$^+X^-$, dihexyldimethylphosphonium$^+X^-$, trihexylmethylphosphonium$^+X^-$, hexyltriethylphosphonium$^+X^-$, trihexyloctylphosphonium$^+X^-$, trihexyldecylphosphonium$^+X^-X^-$, trihexyldodecylphosphonium$^+X^-$, trihexyltetradecylphosphonium$^+X^-$, trihexylhexadecylphosphonium$^+X^-$, octyltrimethylphosphonium$^+X^-$, dioctyldimethylphosphonium$^+X^-$, trioctylmethylphosphonium$^+X^-$, octyltriethylphosphonium$^+X^-$, trioctyldecylphosphonium$^+X^-$, trioctyldodecylphosphonium$^+X^-$, trioctyltetradecylphosphonium$^+X^-$, trioctylhexadecylphosphonium$^+X^-$, tridecylmethylphosphonium$^+X^-$, phenyltrimethylphosphonium$^+X^-$, phenyltriethylphosphonium$^+X^-$, phenyltripropylphosphonium$^+X^-$, phenyltributylphosphonium$^+X^-$, diphenyldimethylphosphonium$^+X^-$, triphenylmethylphosphonium$^+X^-$, and benzyltrimethylphosphonium$^+X^-$. Any one or more of $R^{21}$, $R^{22}$, $R^{23}$, and $R^{24}$ may also include one or more heteroatom-containing groups, such as a nitrile group. The counteranion ($X^-$) in Formula (7) can be any counteranion, such as any of those described earlier above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, any of the phosphonium portions described above contain (e.g., in $R^{21}$, $R^{22}$, $R^{23}$, and/or $R^{24}$) one or more nitrile groups or one or more groups of the formula —$(CH_2)_n$CN as described earlier above.

In some embodiments of Formula (7), two or three of $R^{21}$, $R^{22}$, $R^{23}$, and $R^{24}$ are interconnected to form a phosphonium-containing ring or bicyclic ring system. Some general examples of phosphonium ionic liquids containing a phosphorus-containing ring or bicyclic ring system are provided by the following formulas:

(7a)

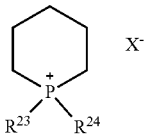

(7b)

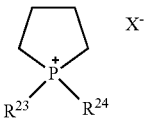

(7c)

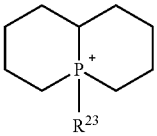

(7d)

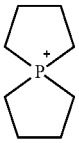

In some embodiments, the cyclic phosphonium ring shown in any of Formulas (7a)-(7d) may have a ring carbon atom replaced with a heteroatom selected from oxygen (O), sulfur (S), and/or nitrogen (—NR—). Moreover, any of the hydrogen atoms residing on ring carbon atoms may be substituted with one or more other groups, such as a hydrocarbon group (R), alkoxide group (—OR), hydroxy group (OH), amino group (—$NH_2$, —NHR, or —$NR_2$), carboxamide group (—C(O)$NR_2$ wherein one or both R groups can be replaced with H), nitrile group, and/or halogen atom (e.g., F, Cl, Br, or I atom), wherein the R groups may be the same or different and may or may not be interconnected to form a ring. Any of the phosphonium cationic portions shown in any of Formulas (7) and (7a)-(7d) may also include one or more substituents containing another neutral or charged phosphorus atom, such that the phosphonium ionic liquid may be a diphosphonium or triphosphonium ionic liquid, as derived from, for example, 1,2-bis(diphenylphosphino)ethane (dppe) by appropriate alkylation.

In other aspects, the ionic liquid is a sulfonium-based ionic liquid. The sulfonium-based ionic liquid can have a structure of the following general formula:

(8)

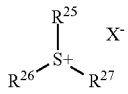

In Formula (8), $R^{25}$, $R^{26}$, and $R^{27}$ independently represent a hydrocarbon group, with or without heteroatom substitution, such as any of the hydrocarbon groups (R) described above for $R^1$, $R^2$ and $R^3$ of Formula (1). Some general examples of sulfonium-based ionic liquids include trimethylsulfonium$^+X^-$, dimethylethylsulfonium$^+X^-$, diethylmethylsulfonium$^+X^-$, triethylsulfonium$^+X^-$, dimethylpropylsulfonium$^+X^-$, dipropylmethylsulfonium$^+X^-$, tripropylsulfonium$^+X^-$, dimethylbutylsulfonium$^+X^-$, dibutylmethylsulfonium$^+X^-$, tributylsulfonium$^+X^-$, dimethylhexylsulfonium$^+X^-$, dihexylmethylsulfonium$^+X^-$, trihexylsulfonium$^+X^-$, dimethyloctylsulfonium$^+X^-$, dioctylmethylsulfonium$^+X^-$, and trioctylsulfonium$^+X^-$. The counteranion ($X^-$) in Formula (8) can be any counteranion, such as any of those described earlier above. In some embodiments, the anion ($X^-$) of the ionic liquid is not chloride, or the anion is bromide or iodide or contains at least one bromine or iodine atom. In some embodiments, the anion ($X^-$) contains at least one nitrile group. In some embodiments, any of the sulfonium portions described above contain (e.g., in $R^{25}$, $R^{26}$, and/or $R^{27}$) one or more nitrile groups or one or more groups of the formula —$(CH_2)_n$CN as described earlier above.

In some embodiments of Formula (8), two or three of $R^{25}$, $R^{26}$, and $R^{27}$ are interconnected to form a sulfonium-containing ring or bicyclic ring system, as described above for the phosphonium cyclic systems. Some examples of sulfonium ionic liquids containing a sulfonium-containing ring or bicyclic ring system are provided by the following formulas:

(8a)

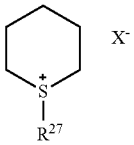

(8b)

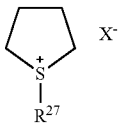

(8c)

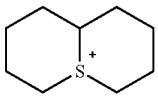

In some embodiments, the cyclic sulfonium ring shown in any of Formulas (8a)-(8c) may have a ring carbon atom replaced with a heteroatom selected from oxygen (O), sulfur (S), and/or nitrogen (—NR—). Moreover, any of the hydrogen atoms residing on ring carbon atoms may be substituted with one or more other groups, such as a hydrocarbon group (R), alkoxide group (—OR), hydroxy group (OH), amino group (—$NH_2$, —NHR, or —$NR_2$), carboxamide group (—C(O)$NR_2$ wherein one or both R groups can be replaced with H), nitrile group, and/or halogen atom (e.g., F, Cl, Br, or I atom), wherein the R groups may be the same or different and may or may not be interconnected to form a ring. Any of the sulfonium cationic portions shown in any of Formulas (8) and (8a)-(8c) may also include one or more substituents containing another neutral or charged sulfur atom, such that the sulfonium ionic liquid may be a disulfonium or trisulfonium ionic liquid, as derived from, for example, a benzodithiophene or 3,3'-dibromo-2,2'-dithiophene by appropriate alkylation.

In some embodiments, any of the above general classes or specific types of cationic portions of the above ionic liquids are excluded. In some embodiments, any of the above general classes or specific types of anionic portions of the above ionic liquids are excluded. In some embodiments, ionic liquids containing a specific combination of one or more general classes or specific types of cationic and anionic portions described above are excluded. In some embodiments, a mixture of two or more of the foregoing ionic liquids is used. In some embodiments, the cationic portion of the ionic liquid contains one or more nitrile groups, or the anionic portion of the ionic liquid contains one or more nitrile groups, or the cationic and anionic portion each contains one or more nitrile groups.

Following step (i), which is the preparation of the PAN composite melt containing the PAN and ionic liquid, the PAN composite melt is subjected to melt spinning (more specifically, plasticized melt spinning) to produce the PAN fiber (step ii). Melt spinning of a wide range of polymer materials, including PAN, is well known in the art, and any such processes can be used herein for melt spinning of the novel PAN composite melt described above. As well known in the art, the melt spinning process typically employs an extrusion step in which the melt is extruded through one or more dies to produce the initial polymer fiber. As the polymer fiber extrudate exits the orifice, it is wound on a spool (rotor) at a desired winding speed.

Before or after being wound, the PAN fiber may be washed (e.g., by dipping into a solvent bath) to remove the ionic liquid. The washing step is herein also referred to as step (iii). The ionic liquid should be substantially soluble in the washing solvent so that the ionic liquid remaining in the PAN fiber is substantially or completely removed. The washing solvent is typically aqueous-based by containing at least a portion thereof as water. Typically, at least 50, 60, 70, 80, 90, 95, or 100 vol % of the washing solvent is water, or more typically, deionized water. A water-miscible co-solvent may be included. The water-miscible co-solvent may be, for example, an alcohol (e.g., methanol, ethanol, isopropanol, or ethylene glycol), acetone, acetonitrile, dimethoxyethane, N-methylpyrrolidone (NMP), or DMF, or combination thereof. Alternatively, a polar solvent (e.g. any of the above solvents) may be used substantially alone or with water included in a minor or trace amount (e.g., less than 20, 10, 5, or 1 vol %), provided that the polar solvent can substantially remove the ionic liquid. In some embodiments, the ionic liquid that has been extracted into the washing solvent is separated from the washing solvent for re-use (recycling) in the present process or other process by means well known in the art. For example, the ionic liquid can be easily recovered by evaporation of the water or other solvent admixed with the ionic liquid.

In another aspect, the present disclosure is directed to a method for producing carbon fiber by carbonizing the PAN fiber described above, as produced from the PAN-IL composite melt. PAN fiber produced after step (ii) or step (iii) may be carbonized by methods well known in the art to produce the carbon fiber.

As well known in the art, prior to a carbonization process, the PAN fiber is subjected to a thermal oxidative stabilization process. In the stabilization process, the PAN fiber is heated in the presence of oxygen (typically air, oxygen-enriched air, or other oxidant, such as ozone) to render the precursor infusible so that it becomes substantially carbonizable rather than volatile during the subsequent carbonization process. In some embodiments, the stabilization process may be conducted at a conventional temperature above 200° C., such as 250° C. or above, for a conventional time period of, for example, at least 120 minutes. However, as mentioned earlier above, the above-described PAN fiber production process advantageously permits a milder stabilization process on the PAN fiber before the carbonization process. The stabilization process may thus be conducted at a temperature of, for example, no more than or less than 200° C., 180° C., or 150° C. The stabilization may alternatively or in addition be conducted over a shorter than conventional stabilizing time period of no more than or less than, for example, 90, 80, 60, 45, or 30 minutes (wherein a conventional or lower than conventional temperature may be used with the reduced time period).

In some embodiments, the PAN fiber is subjected to tension and/or a magnetic field (e.g., at least 1 Tesla) during the stabilization process. In some embodiments, the temperature used in the stabilization, while the PAN fiber is under tension or exposed to a magnetic field, may be at or slightly below the glass transition temperature ($T_g$) of the PAN fiber. In some embodiments, the maximum temperature used in the stabilization process is, for example, 350° C., 300° C., 250° C., 200° C., 150° C., or 100° C., or the maximum temperature is within a range bounded by any two of the foregoing maximum or intermediate values (e.g., 100-180° C.). Under the above stabilization conditions, the PAN fiber is softened (i.e., afforded sufficient plasticity) but not melted, in order to provide the grains of the solid polymer sufficient microscopic and molecular freedom to rearrange (i.e., reorganize) into a significantly more ordered form, wherein the magnetic field and/or applied tension work in concert to impart the ordering of the polymer domains (and optionally, the particles) while in the softened state. The ordering particularly considered herein is axial ordering, wherein the term "axial" refers to the lengthwise dimension of the PAN fiber.

In the stabilization process, the PAN fiber may be heated gradually at a specified rate of temperature increase to the maximum temperature used in the stabilization process. The rate of temperature increase may be carefully controlled. In particular, a slow rate of temperature increase may be beneficial in producing a carbonized fiber having a higher degree of structural order and improved mechanical properties resulting therefrom. In particular embodiments, the rate of temperature increase starting from ambient temperature (i.e., room temperature, generally 15, 20, 25, or 30° C. or therebetween) to the maximum temperature used in the stabilization process may be no more than or less than 5° C./min, 2° C./min, 1° C./min, or 0.5° C./min.

If a magnetic field is applied to the PAN fiber in the stabilization process, the magnetic field may be at least 1 Tesla. In different embodiments, the magnetic field used in the stabilization process is precisely, about, at least, above, up to, or less than, for example, 2, 3, 4, 5, 6, 7, 8, or 9 Tesla, or the magnetic field is within a range bounded by any two of the foregoing exemplary values. In one embodiment, the magnetic field is static, while in another embodiment, the magnetic field is alternating, e.g., 1, 5, 10, 50, 100, 200, 300, 400, 500, 1000, 2000, 5000, 10,000, 15,000, or 20,000 Hz. The magnetic field can be provided by any magnetic source known in the art capable of providing the magnetic fields required herein. In a preferred embodiment, the magnetic field is provided by a superconducting magnet. In some embodiments, a single magnet is used, while in other embodiments two or more magnets are used.

The magnet is positioned relative to the PAN fiber such that the PAN fiber is subjected to the desired magnetic field. The magnet can also be positioned or operated by means known in the art to orient the magnetic field in a desired direction relative to the PAN fiber. For example, the magnetic field can be oriented precisely or substantially parallel, perpendicular, or at an oblique angle to the length of the PAN fiber. In particular embodiments, the PAN fiber is passed through a cylindrical reaction tube surrounded by a superconducting magnet, wherein the magnetic field is typically oriented parallel to the length of the fiber when the fiber is oriented parallel to the length of the reaction tube. The foregoing embodiment can be conveniently practiced by, for example, incorporating a refractory reaction tube in the bore of a superconducting magnet. The fiber may be either continuously passed through the cylindrical reaction tube (e.g., fed from a winding of fiber) or processed in a batchwise manner. Typically, particularly in the case of a superconducting magnet, a cooling system is included to prevent overheating of the magnet.

In some embodiments, the magnetic field is maintained at the same or substantially the same magnetic field strength for the length of time that the PAN fiber is exposed to the magnetic field. In other embodiments, the magnetic field is varied in magnetic field strength, such as by a gradual or sudden increase or decrease in magnetic field strength between any of the exemplary magnetic field strengths provided above.

If an axial tension (stress applied along the length of the fiber) is applied to the PAN fiber in the stabilization process, the applied axial stress is typically at least 0.1 MPa. In different embodiments, the applied axial tension is about, at least, above, up to, or less than, for example, 0.1, 0.3, 0.5, 1, 2, 5, 10, 15, or 20 MPa.

In some embodiments, the PAN fiber may alternatively or in addition be subjected to electromagnetic, plasma, or particle beam (e.g., electron or neutron beam) radiation during the stabilization or subsequent carbonization process. The electromagnetic, plasma, or particle beam exposure generally has the effect of improving the strength and/or modulus of the resulting carbonized fiber. The operation and use of electromagnetic, plasma, and particle beam radiation techniques are well known in the art.

The stabilized PAN fiber is then subjected to a carbonization process to convert the PAN fiber to a carbonized fiber. Methods of converting PAN fiber to carbon fiber are well known in the art. As well known, the reaction tube or chamber in which the PAN fiber is carbonized typically includes one or more heating elements to heat the reaction tube or chamber to a desired carbonization temperature. In some embodiments, the reaction tube or chamber includes one or more heating elements (e.g., a SiC heating element) on an end of the reaction tube or wall of a reaction chamber, or multiple heating elements may be located on different ends or locations (e.g., midpoint) of the reaction tube or chamber. In other embodiments, a substantially uniform temperature is provided to the length of the fiber in the tube or chamber, such as by including an induction coil (or other heating element) that surrounds at least a portion or entire length of the PAN fiber located in the reaction tube or chamber. By methods known in the art, the induction coil can be heated to a desired temperature by controlling the amount of high-frequency alternating current in its operation.

The carbonization step includes any of the conditions, as well known in the art, that result in carbonization of the PAN fiber to form a carbonized fiber. In different embodiments, the carbonization temperature is precisely, about, at least, or above, for example, 400° C., 450° C., 500° C., 550° C., 600° C., 650° C., 700° C., 750° C., 800° C., 850° C., 900° C., 950° C., 1000° C., 1050° C., 1100° C., 1150° C., 1200° C., 1250° C., 1300° C., 1350° C., 1400° C., 1450° C., 1500° C., 1600° C., 1700° C., 1800° C., 1900° C., 2000° C., 2100° C., or 2200° C., or a temperature within a range bounded by any two of the foregoing temperatures (e.g., at least 400° C. or 500° C. and up to or less than 1500° C., 1800° C., 2000° C., or 2200° C.). The amount of time that the PAN fiber is subjected to the carbonization temperature (i.e., carbonization time) is highly dependent on the carbonization temperature employed. Generally, the higher the carbonization temperature employed, the shorter the amount of time required. In different embodiments, depending on the carbonization temperature and other factors (e.g., pressure), the carbonization processing time may be, for example, about, at least, or no more than 0.02, 0.05, 0.1, 0.125, 0.25, 0.5, 1, 2, 3, 4, 5, 6, 7, 8, 9, 10, 11, or 12 hours, or within a range therein. In particular embodiments, it may be preferred to gradually raise the temperature at a set or varied temperature ramp rate (e.g., 5° C./min, 10° C./min, or 20° C./min). In particular embodiments, it may be preferred to pass the PAN fiber through a furnace with a gradient of temperature at the entrance and exit of the furnace and at a set temperature inside the furnace in order to achieve the desired residence time. In other embodiments, it may be preferred to subject the PAN fiber to a sudden (i.e., non-gradual) carbonization temperature. In some embodiments, after the PAN fiber is subjected to a desired carbonization temperature for a particular amount of time, the temperature is reduced gradually (e.g., at any of the ramp rates provided above).

In particular embodiments, the carbonization process includes a low temperature carbonization step followed by a high temperature carbonization step. The two steps may be run at different temperatures independently selected from any of the exemplary temperatures provided above. In some embodiments, the low temperature step is employed as a pyrolysis step, i.e., to remove volatiles. The low temperature step can be conducted at a temperature of, for example, at least or above 400, 500, or 600° C., and up to or less than 800, 900, 1000° C., 1100° C., or 1200° C. The high temperature step is generally employed to substantially or completely carbonize the PAN fiber. The high temperature step is preferably conducted at a temperature of at least or above 1200, 1300, 1400, 1500, 1600, 1700, 1800, 1900, 2000, or 2100° C., or at a temperature within a range bounded by any two of the foregoing temperatures, or at a temperature within a range bounded by any of the foregoing temperatures and up to or less than 2200° C. The processing times for the low and high temperature steps can each be, independently, any of the processing times provided above. Alternatively, the combined time for the low and high temperature steps may correspond to any of the processing times provided above. If desired, one or more additional carbonization steps may be included with temperatures intermediate to the first and second carbonization steps. In some embodiments, the different steps are characterized by a distinct (i.e., non-gradual) change in temperature, such as from 600° C. in a low temperature step to 1200° C. or higher in a high temperature step. Preferably, the PAN fiber is maintained in the same reaction tube or chamber when subjected to successive carbonization steps. In other embodiments, the demarcation between carbonization steps is not so distinct, such as by gradually increasing the carbonization temperature to transition from one step into the next.

In some embodiments, the PAN fiber is not exposed to a magnetic field during the carbonization process. In other embodiments, the PAN fiber is exposed to a magnetic field during the carbonization process, in which case the magnetic field can independently have any of the magnetic field strengths and frequencies provided above for the stabilization process. In the case of a two-step carbonization process, the PAN fiber can be subjected to the magnetic field either during the low temperature or high temperature carbonization step, or in both the low temperature and high temperature carbonization steps. In yet other embodiments, the PAN fiber is subjected to a magnetic field of any desired strength of at least 3 T only when a particular temperature is reached, and eventually the magnetic field is removed after a specified period of time or when a second temperature is reached (wherein the second temperature may be higher or lower than the first temperature).

If desired, the carbonized fiber can be subjected to a temperature high enough to graphitize the carbonized fiber. Typically, the temperature capable of causing graphitization is a temperature of at least or above, for example, 2200° C., 2300° C., 2400° C., 2500° C., 2600° C., 2700° C., 2800° C., 2900° C., 3000° C., 3100° C., or 3200° C., or a temperature within a range bounded by any two of the foregoing temperatures (e.g., at least or above 2200° C. and up to or less than 3200° C.). The graphitization process may or may not also include a magnetic field, such as any of the magnetic field strengths provided above for the carbonization process.

In some embodiments, the carbonization or graphitization process is conducted in air or other oxygen-containing atmosphere. In other embodiments, the carbonization or graphitization step is conducted in an atmosphere substantially devoid of a reactive gas (e.g., oxygen or hydrogen), or an inert atmosphere, such as nitrogen ($N_2$) or a noble gas (e.g., helium or argon). The inert gas is generally made to flow at a specified flow rate, such as 0.1, 0.25, 0.50, 1, 5, 10, 20, or 30 L/min. However, one or more reactive functionalizing species may be included in the carbonization step or in a post-treatment step (e.g., at the exit of the furnace as a post-carbonization step) to suitably functionalize the carbonized fiber, e.g., by inclusion of a fluorocarbon compound to fluorinate, or inclusion of an oxygen-containing species to oxygenate (e.g., by forming hydroxy or ether groups), or inclusion of amino-, thio-, or phosphino-species to, respectively, aminate, thiolate, or phosphinate the carbonized fiber. Thus, in some embodiments, it may be desired to include at least one reactive gas, such as oxygen, hydrogen, ammonia, an organoamine, carbon dioxide, methane, a fluoroalkane, a phosphine, or a mercaptan. The one or more reactive gases may, for example, desirably change or adjust the compositional, structural, or physical characteristics of the carbonized fiber. The functionalized groups on the carbonized fiber can have a variety of functions, e.g., to bind to metal species that are catalytically active, or to modify or adjust the surface miscibility, absorptive, or wetability characteristics, such as for gas absorption and filtration applications.

The pressure employed in the carbonization (or graphitization) step is typically ambient (e.g., around 1 atm). However, in some embodiments, it may be preferred to use a higher pressure (e.g., above 1 atm, such as 1.5, 2, 5, 10, 20, 50, or 100 atm, or within a range therein) to, for example, maintain a positive pressure inside the reaction tube, chamber, or furnace and keep the sample free of oxygen at high temperature to avoid combustion or partial combustion. In other embodiments, it may be preferred to use a lower pressure (e.g., below 1 atm, such as 0.5, 0.1, 0.05, or 0.01 atm, or within a range therein).

In some embodiments, the PAN fiber is subjected to a stress (tension) along the length of the fiber during carbonization and/or graphitization. The stress can be applied to, for example, avoid fiber shrinkage, or to favorably affect or adjust properties of the resulting carbonized fiber, such as fiber strength, elasticity, elongation, crystallinity, morphology, and pore size distribution. In different embodiments, the fiber, either during carbonization and/or graphitization, is subjected to 0.1, 0.3, 0.5, 1, 2, 5, 10, or 20 MPa of stress. In other embodiments, no tension is applied to the fiber during carbonization and/or graphitization.

In other embodiments, the fiber is subjected to an electromagnetic, plasma, or particle beam (e.g., electron or neutron beam) radiation during the carbonization and/or graphitization process. The electromagnetic, plasma, or particle beam exposure generally has the effect of improving the strength and/or modulus of the resulting carbonized fiber. The operation and use of electromagnetic, plasma, and particle beam radiation techniques are well known in the art.

The carbonized fiber produced by the above-described process generally has a high strength, wherein the term "high strength", as used herein, generally refers to a tensile strength of at least or greater than, for example, 600, 650, 700, 750, 800, 850, 900, 950, 1000, 1100, 1200, 1300, 1400, 1500, 1600, 1700, 1800, 1900, or 2000 ksi, (which corresponds to approximately to 4-14 GPa), or a tensile strength within a range bounded by any two of the foregoing exemplary values. In some embodiments, the carbonized fiber may also have a high modulus, wherein the term "high modulus", as used herein, generally refers to an elastic (i.e., tensile) modulus of at least 30 megapounds per square inch (30 msi), which corresponds to approximately 207 GPa. In different embodiments, the carbonized fiber has an elastic modulus of at least or greater than, for example, 30, 35, 40, 45, 50, 55, 60, 65, 70, 75, 80, 85, 90, 95, 100, 110, 120, 130, 140, or 150 msi (which corresponds to approximately 210-1050 GPa), or an elastic modulus within a range bounded by any two of the foregoing exemplary values. The elastic modulus of the carbonized fiber may be influenced by the graphitic crystal structure in the carbonized fiber and its interaction with turbostratic domains. In some embodiments, the starting PAN fiber, stabilized PAN fiber, or carbonized fiber possesses a substantial elongation, wherein the term "elongation", as used herein, which is synonymous with the terms "ultimate elongation" and "elongation at break", generally refers to an elongation of at least 1.5%. In different embodiments, the fiber exhibits an elongation of precisely, about, at least, or greater than, for example, 1.5%, 1.8%, 2%, 2.2%, or 2.5%, or an elongation within a range bounded by any two of the foregoing exemplary values. The fiber may also advantageously possess a thermal conductivity of at least, above, up to, or less than, for example, 0.1, 1, 10, 50, 100, 150, 200, 250, 300, 350, 400, 500, 1000, 1500, 2000, or 2500 W/m-K.

The carbonized fiber may have any degree of crystallinity, including amorphous, graphitic, crystalline, and semi-crystalline forms of carbon. In some embodiments, the carbonized fiber may have characteristics of a single type of carbon structure throughout the carbonized fiber, while in other embodiments, the carbonized fiber may have two or more types of carbon structure, e.g., a more pronounced graphitic structure on the outer surface of the carbonized fiber and a more pronounced amorphous structure below the surface or in inner layers of the carbonized fiber. Notably, carbonized fiber produced from PAN will generally include an appreciable amount of nitrogen by virtue of the nitrile groups in PAN. One or more additional elements other than carbon and nitrogen may be included, generally in a dopant amount (e.g., up to or less than 10,000, 5,000, 1,000, 500, or 100 ppm). The element other than carbon and nitrogen can be, for example, fluorine, boron, oxygen, sulfur, or phosphorus, or a combination thereof. The additional element can be introduced into the fiber by, for example, including a doping gas (e.g., oxygen, fluorine, borane, phosphine, or hydrogen sulfide) is the tube or chamber in which the fiber is undergoing the carbonization process.

In some embodiments, the carbonized fiber is in the form of a tow, while in other embodiments the carbonized fiber is in the form of a single filament. The carbonized fiber or tow can have any desired thickness (i.e., diameter). For example, in different embodiments, the carbonized fiber or tow can have a thickness of 0.1, 0.2, 0.5, 1, 2, 5, 10, 15, 20, 30, 40, 50, 60, 70, 80, 90, or 100 microns, or a thickness within a range bounded by any two of these values. Continuous filaments or tows from very low count (<500) to very high counts (>50 k) are considered herein. The carbonized fibers may also be stapled or chopped to form short segments or even particles, any of which may have widths or overall or average sizes of up to or less than, for example, 1 cm, 1 mm, or 1 micron. By suitable construction or weaving methods on the PAN fiber or carbonized fiber, as known in the art, the carbonized fiber may be in the form of a yarn, fabric, mesh (e.g., mat or web), or felt. The PAN fiber may also have any of the foregoing thicknesses, shapes, and forms. Typically, the PAN fiber and carbon fiber produced by the methods described above are substantially or completely non-porous and substantially devoid of physical defects, such as voids and cracks.

Examples have been set forth below for the purpose of illustration and to describe certain specific embodiments of the invention. However, the scope of this invention is not to be in any way limited by the examples set forth herein.

Examples

The following experiments investigated the effect of different ILs on the structural, thermal, and mechanical properties of melt-spun PAN fibers using differential scanning calorimetry (DSC), thermogravimetric analysis (TGA), scanning electron microscopy (SEM), Fourier transform infrared spectroscopy (FTIR), X-ray diffraction (XRD), and mechanical testing. Five imidazolium-based ILs were synthesized for this study to systematically investigate the effects of alkyl and substituent functional groups and counteranions on the efficiency of IL plasticization on commercial textile-grade PAN. PAN fibers have herein been successfully prepared by melt-spinning, which provides a promising cost-/energy-efficient method to prepare PAN precursor fibers.

Figure 1B:
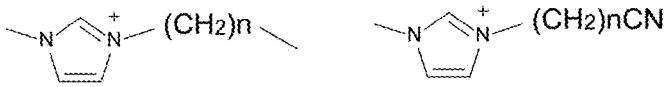
Figure 1B:
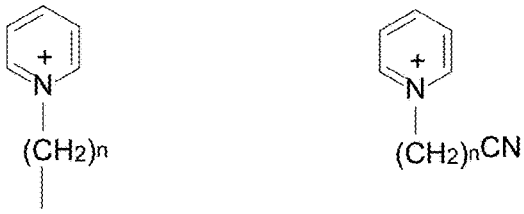
Figure 1B:
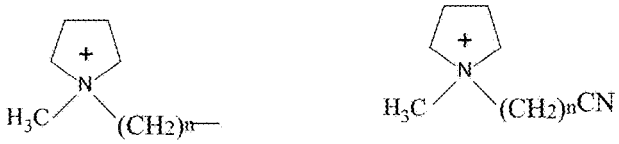

Materials. Textile-grade PAN powder (MW=$1.6\times10^5$ g/mol) containing 93/7 mole ratio of acrylonitrile/vinyl acetate was used. The following ionic liquids (ILs) were synthesized by well known methods, and their structures are shown in FIG. 1A: 1-propyl-3-methylimidazolium bromide ([$C_3$mim]Br), 1-butyl-3-methylimidazolium bromide ([$C_4$mim]Br), 1-butyl-3-methylimidazolium chloride ([$C_4$mim]Cl), 1-(3-cyanopropyl)-3-methylimidazolium bromide ([MPCNIm]Br), and 1-(3-cyanopropyl)-3-methylimidazolium chloride ([MPCNIm]Cl). FIG. 1B depicts a range of exemplary ionic liquids useful in the present invention.

Preparation of PAN composite melts. PAN composite melts were prepared by mixing PAN powder with IL and heating to a certain temperature for a period of time. The typical procedure is as follows: dry white PAN powder was mixed with the IL in a 20 mL glass vial. The PAN-IL mixture was then purged with argon for one minute and was heated to a temperature ranging from 120 to 170° C., depending on the IL type used, with a heating block until a homogeneous melt was formed. The initial samples prepared for this study contained 3/7 ratio of PAN/IL.

Plasticized melt spinning of PAN fibers. Melt spinning experiments were performed with an Atlas Laboratory Melt Extruder and Take Up System. For the experiments, the rotor temperature was set to ~150° C., the header temperature was set to ~160° C., and rotational speed was set to 90 RPM. When the melted polymer composite is extruded from the orifice, i.e. the extrudate, the polymer thread was initially wrapped around the take up spool with tweezers. Once the thread was wrapped around, the take up speed for spinning of the PAN precursor was maintained approximately 60 ft/min. Ionic liquids recovery was investigated by contacting either the composite melts or the as-spun fibers with deionized water for ~18 hours and then dried at 100° C. for 2 hours.

Measurements. Scanning Electron Microscopy (SEM, JSM-6060 JEOL) was used to survey the cross-sectional and surface morphologies of the melt-spun PAN fibers before and after the removal of the ILs. Differential scanning calorimeter (DSC Q100, TA Instruments) was used to determine the thermal performance of the pure ionic liquids, pure PAN powder, PAN-IL composite melts and the PAN fibers before and after the removal of the ILs. The samples were heated under nitrogen to 60° C. at a rate of 10° C./min and held there for 10 minutes to give uniform starting temperature regardless their previous treatment condition (e.g., no washing or washing and drying in DI water, etc.). The samples were then heated to 400° C. and cooled back to room temperature with a heating and cooling rate of 10° C./min. Thermogravimetric analysis (TGA 2950, TA Instruments) was used to calculate the carbon yield of the pure ILs, pure PAN powder, PAN-IL composite melts and the PAN fibers before and after the removal of the ILs. Samples were heated in $N_2$ from room temperature to 800° C. at a rate of 10° C./min. The rheometer (AR2000ex, TA Instruments) was fitted with a 25.0 mm diameter cone and plate fixture. To determine the viscosity of select PAN-IL composites, a temperature sweep was performed from 140° C. to 280° C. at 5° C./min. The angular frequency, ω, was held constant at 1 rad/s. The infrared spectra at multiple stages of fiber formation was recorded using a FTIR spectrometer (Perkin Elmer Frontier FTIR). Each sample was measured using the attenuated total reflectance mode (ATR). Each measurement was taken from 650 $cm^{-1}$ to 4000 $cm^{-1}$ with an average of 16 scans and a resolution of 4 $cm^{-1}$. The mechanical properties of the as-spun and washed PAN fibers were preformed using an Instron 5943 Universal Testing Machine. The fibers were fixed on paper mounts with a 25.4 mm gauge length and 10 mm/min speed. A minimum of 40 tests were performed for each PAN-IL fiber to obtain the average elastic modulus, tensile strength, and extension.

X-ray diffraction (XRD) analysis using CuKα (λ=0.1542 nm) of the PAN fibers was conducted using a PANalytical Empyrean diffractometer, operated at 45 kV and 40 mA (scanned at 0.026° per step). The crystalline orientation of the fibers was obtained by wide angle X-ray diffraction (WAXD) using X'Pert3 MRD instrument. The average crystal size <L(200)> was calculated using the Scherrer equation:

$$\langle L(200)\rangle = \kappa\lambda/\beta\cos\theta$$

where κ is the constant for the device used, which was taken to be 0.9; λ=0.1542 nm for wavelength of CuKα X-rays; β is the full width at half maximum in radians at (200) reflection corresponding to 2θ~17.2°. The crystallinity in the spun PAN fibers was determined from the XRD data of the fibers using Hinrichsen's method. The diffraction peak was deconvoluted to two peaks based on contributions by crystalline and amorphous phases and based on the relative areas of these peaks, the percent of crystallinity in the fibers was calculated. The qualitative degree of orientation of the crystalline phase of the fibers along the fiber direction was obtained from the azimuthal scan data of the fibers associated with the (200) planes at 2θ=17.2°, and the degree of orientation determined by the following expression: % degree orientation=(180-H)*100/180, where H is the full width at half the maximum intensity at 2θ=17.2° diffraction.

Results and Discussion

Thermophysical characterization of ILs, PAN, and PAN-IL composites. The thermal analysis of the ILs, PAN, and PAN-IL composites are important for quantifying and understanding the plasticization effect of the ionic liquids on PAN composite melts. Ionic liquids with halide as anion are known to be relatively hygroscopic and readily absorb water when exposed to air. This will result in an endothermic transitions during DSC experiments centered around 100° C. where the vaporization of the water will occur. To remove the absorbed water from the ILs, PAN, and PAN-IL composites the samples were placed in a vacuum oven at 55° C. for 24 hours.

Figure 2:
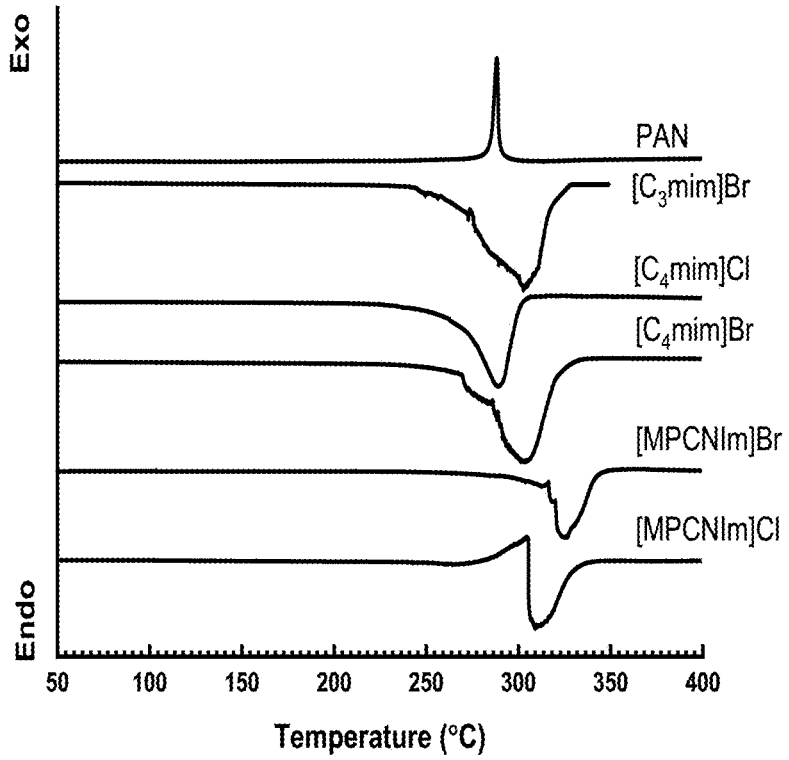
FIG. 2. Differential scanning calorimetry (DSC) thermograms of neat PAN and ionic liquids (A)-(E).

FIG. 2 shows DSC thermograms of neat PAN and the ILs under study. As shown in FIG. 2, the DSC thermograms for the neat ILs each exhibits one endothermic phase transition at temperatures above 250° C. This endothermic phase transition peak corresponds to the decomposition temperature of the ILs. PAN exhibits a large single exotherm from the cyclization reactions of the nitrile (CN) groups centered at 289° C. Due to the slow heating rates, the melting behavior of PAN is not visible on the thermograms. Additionally, the cyclization reaction changes the nature of the PAN. The generally accepted melting temperature of neat PAN is approximately 320° C.

Figure 3:
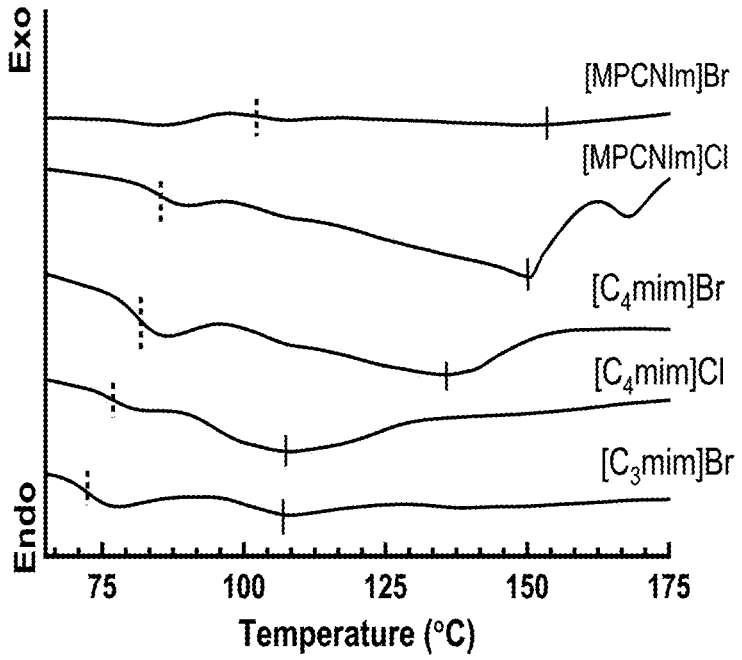
FIG. 3. DSC curves showing effect of ionic liquid structure on the glass transition and melting behavior of PAN composite melts.

It is necessary to understand the plasticization effects the ILs have on PAN during the composite stage in order to determine the melt spinning processability of PAN into fibers. FIG. 3 presents DSC curves showing the effect of ionic liquid structure on the glass transition and melting behavior of PAN composite melts The DSC curves in FIG. 3 illustrate that the glass transition temperature ($T_g$) and melting temperature ($T_m$) for 30 wt. % PAN in five ILs are visible and greatly suppressed compared to the literature value of pure PAN. In FIG. 3, the dotted vertical lines represent the measured $T_g$ of a given PAN composite and the solid vertical lines represent their $T_m$. The ILs have depressed the $T_m$ of PAN composite melts by over 150° C. and the $T_g$ up to 13° C.

As shown in FIG. 3 and Table 1 (below), as the plasticizing IL becomes bulkier or larger, by either an increase in carbon chain length or a nitrile on the end of the alkyl chain, the $T_m$ and $T_g$ are depressed less when compared to a smaller alkyl chain. However, when the IL cation is the same, the IL with a chloride anion has lower transition temperatures compared to the same cation with a bromide anion. For example, for composites with 30 wt. % PAN in [$C_4$mim]Cl, the $T_m$ is 108.3° C. and for [$C_4$mim]Br the $T_m$ is 139.0° C. The foregoing observation may be a result of the chloride anion being smaller than the bromide anion as well as the chloride anion having a larger electronegativity compared to bromide. It has been hypothesized that the addition of ILs into a PAN matrix the ionic liquids will create more disorder between the polymer chains. In Table 1, the heat of fusion ($\Delta H_f$) for ILs containing chloride anions are larger than bromide anions with the same corresponding cation. The smaller $\Delta H_f$, such as for 30 wt. % PAN in [$C_3$mim]Br, corresponds to a higher disordered state as a result of the IL penetrating into the crystalline domains of PAN and disrupting chain alignment. These DSC results indicate that PAN precursor fiber should be easily melt-spun at low temperatures for the production of carbon fiber precursors.

TABLE 1

DSC Data five PAN composite melts containing 30 wt. % PAN

| Ionic Liquid | $T_g$ (° C.) | $T_m$ (° C.) | $\Delta T = T_f - T_i$ (° C.) | $\Delta H_f$ (J/g) |
|---|---|---|---|---|
| [$C_3$mim]Br | 72.1 | 107.6 | 43.9 | 1.12 |
| [$C_4$mim]Br | 82.1 | 138.4 | 39.6 | 6.38 |
| [$C_4$mim]Cl | 76.6 | 108.3 | 69.9 | 10.2 |
| [MPCNIm]Br | 86.0 | 157.2 | 85.6 | 6.97 |
| [MPCNIm]Cl | 85.4 | 150.6 | 76.7 | 18.1 |

Figure 4:
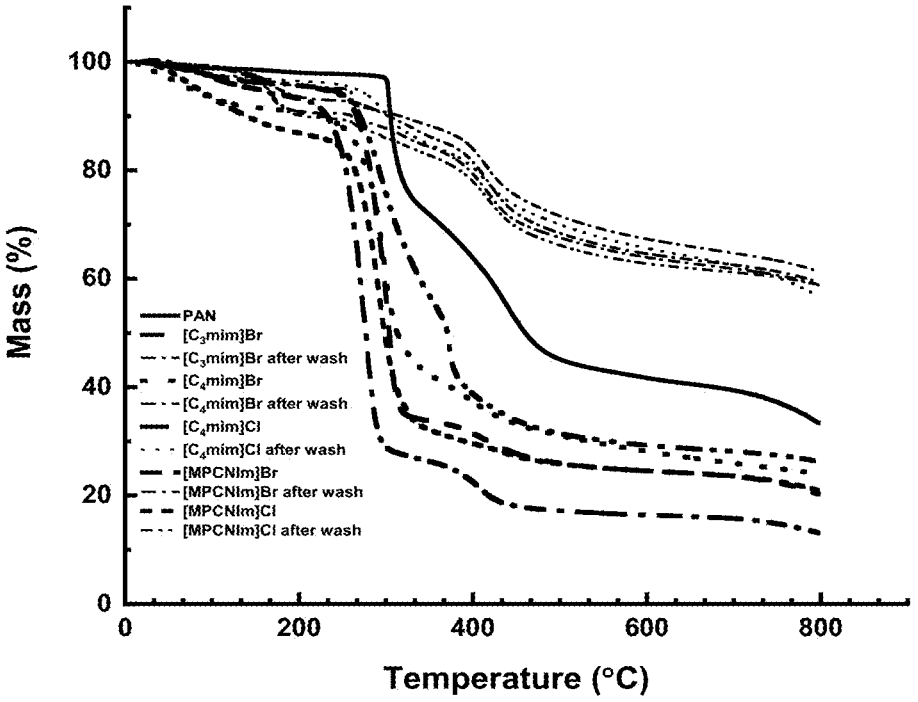
FIG. 4. Thermogravimetric analysis (TGA) curves of PAN and PAN-IL composites (solid lines) and after contacting with water (dotted line).

TGA was performed under a nitrogen atmosphere to determine the thermal stability and carbon yield for PAN, ILs, and PAN-ILs composites. FIG. 4 shows the weight loss and thermal stability for five PAN composites. The TGA curves of PAN and PAN-IL composites are shown as solid lines, while TGA curves after contacting PAN and composites with water are shown as dotted lines. There is an initial mass loss at 100° C. for all PAN-IL samples. This mass loss is the result of the release of water from the composites. The composites show a rapid weight loss between 200 and 300° C., which corresponds to the thermal degradation of the ILs as observed in FIG. 2. PAN composites with ILs containing bromide anions gave overall higher carbon yields when compared to ILs containing chloride anions at 800° C. As the ILs become bulkier, i.e. longer carbon side chain length or additional nitrile groups, the carbon yield increases, which suggests that the ionic liquids are acting as carbon generators. The recyclability of the ILs from the composites were also investigated. These preliminary tests indicate that the ILs can be easily recycled simply by contacting them with water. Removing the ILs increased the carbon yield of PAN by about 40% compared to the original PAN-IL composites, as shown in Table 2 (below) and FIG. 4. Comparing the carbon yields from the composites to neat PAN before and after washing, it becomes apparent that the ionic liquids may help align polymer chains during formation of the PAN-IL composite melts. The carbon yield for these PAN-IL composites after recycling water are comparable to the carbon yield of commercial solution-spun PAN fibers.

TABLE 2

Carbon yield characterization of PAN-IL composite melts.

| Ionic Liquid | PAN (%) | Carbon Yield (%) at 800 (° C.) Original | After contact with water |
|---|---|---|---|
| PAN | 100 | 33.4 | — |
| [$C_3$mim]Br | 30 | 20.4 | 60.0 |
| [$C_4$mim]Br | 30 | 24 | 59.4 |
| [$C_4$mim]Cl | 30 | 13.1 | 56.1 |
| [MPCNIm]Br | 30 | 26.5 | 61.4 |
| [MPCNIm]Cl | 30 | 21.1 | 58.8 |

Preliminary Rheology Experiments. The rheology measurements are an important technique to determine the "melt spinnability" of the composite materials. The melt spinnability or processability is determined by the thermal rheological behaviors under the theoretical spinning conditions. Viscosity is the measurement of the materials resistance to flow. Temperature-dependent complex viscosity profile is useful to determining the minimum viscosity the composites can achieve before the inherent crosslinking between nitriles on PAN commences. The viscosity curves are influenced by two physical properties of the composites as a function of temperature: (1) the molecular activity of the polymer was increased leading to an initial, exponential decrease in viscosity and (2) the polymer exhibited crosslinking at temperatures >260° C., resulting in a steep increase in viscosity.

Figure 5:
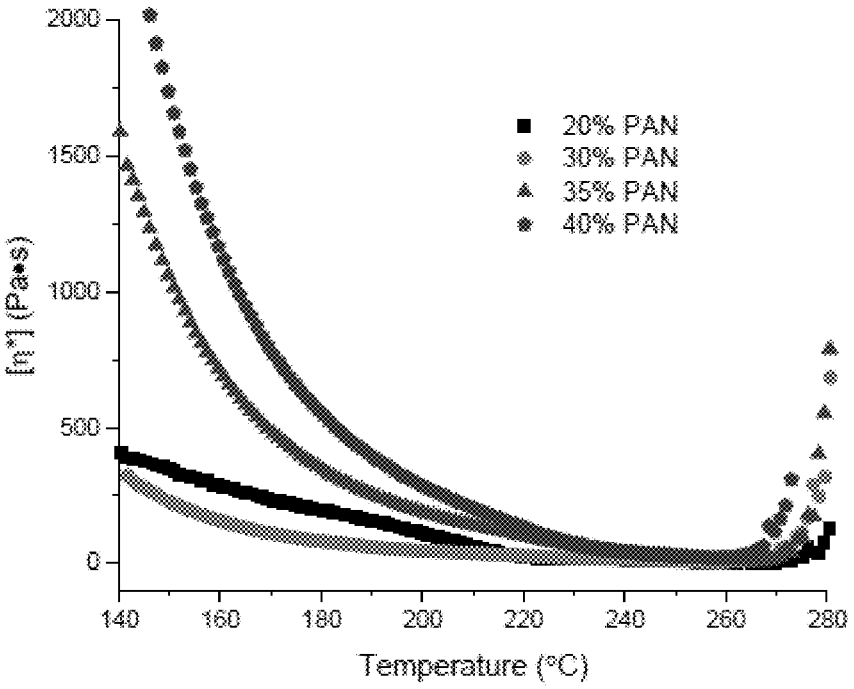
FIG. 5. Graph showing complex viscosity of different weight percentages (20, 30, 35, and 40%) of PAN-[$C_4$mim]Cl melts.

A PAN concentration series with [$C_4$mim]Cl as the plasticizing IL was investigated. FIG. 5 shows the effect of PAN concentration, which was increased from 20% to 40% on viscosity. Generally, the viscosity increases when increasing the PAN concentration from 20 to 40%, although in the low-temperature region, the 20% PAN-containing composition showed slightly higher viscosity than the 30% PAN-containing counterpart. This anomaly could be linked to inhomogeneity in the lower amount of PAN in the material. The increase in viscosity is due to the longer time for a uniform melt to form when increasing the PAN concentration. At lower PAN concentrations, the composites are gel-like melts that are easily pliable. However, when increasing the PAN concentration, the composites became more solid and brittle. As the concentration of PAN is increased, the composites require more energy for the polymer chains to move freely, which results in a slower decrease in viscosity as a function of temperature. From these initial rheological experiments, the temperature selected for preliminary melt-spinning experiments was 150° C. and a 30% PAN sample was selected for the melt-spinning experiments.

Figures 6A, 6B:
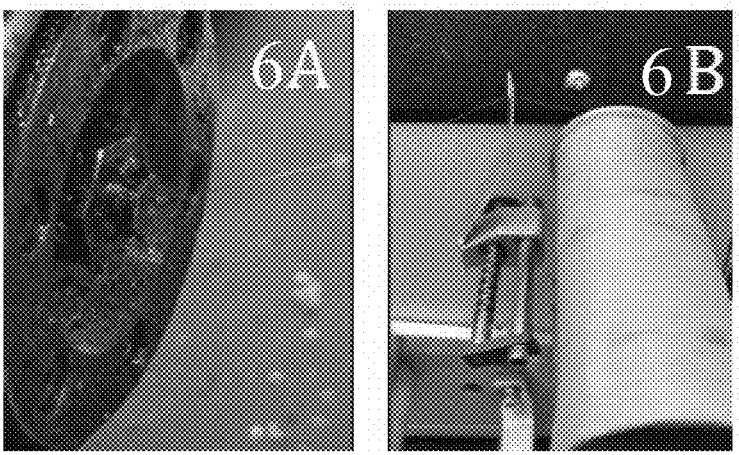
FIGS. 6A-6B.

Preliminary Melt Spinning Experiments. An Atlas Laboratory Mixing Extruder (LME) was used to perform preliminary melt spinning experiments. The LME uses rotational shearing and provides extensive mixing of the PAN-IL composites before extrusion. The LME has a maximum working temperature of 400° C., variable rotational speed of 5-260 rpm, and an orifice with a size of ⅛ in. The temperature of the rotor and orifice header are controlled separately through two PIDs. Combining the LME with the Take Up System (TUS) makes it possible to spool and slightly stretch the fiber during formation. The TUS has a maximum take-up speed of 250 ft/min. The LME is a beneficial preliminary tool because it can process fibers with a small sample starting size (~3 grams). FIG. 6A shows a spinner head of the melt spinning apparatus used. FIG. 6B shows spun fibers on a spool in the melt spinning apparatus used.

For initial experiments, the rotor temperature was set to 150° C., the header temperature was set to 160° C., and rotational speed was set to 90 rpm. When the melted polymer composite was extruded from the orifice, also known as the extrudate, the polymer was picked up using a tweezer and wrapped around the take-up spool. The take-up speed for spinning of the PAN precursor was approximately 60 ft/min. The 5 PAN-IL composites that were tested all contained 30 wt % of PAN. The reason that 30% of PAN containing IL compositions were selected for fiber formation experiments is that these formed the most homogeneous melts and their rheologic properties are the best suitable for melt-spinning at 150° C. The ILs selected for the initial composites included [$C_3$mim]Br, [$C_4$mim]Br, [$C_4$mim]Cl, [MPCNIm]Br, and [MPCNIm]Cl, as shown in FIG. 1A.

Figure 7:
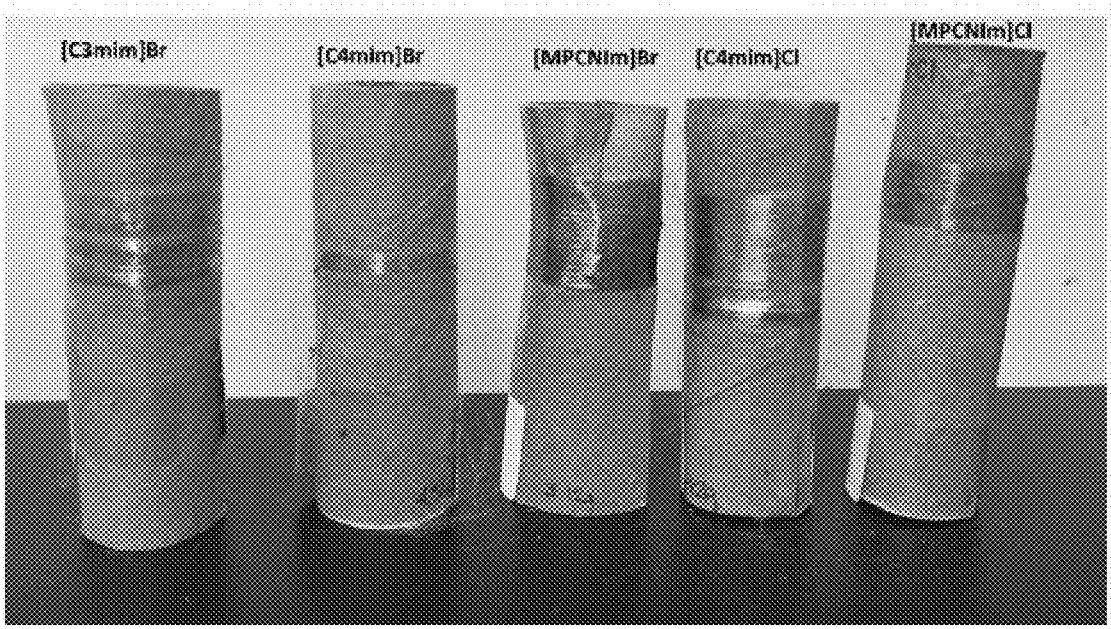
FIG. 7. Melt-spun PAN fiber from PAN-IL composites containing [$C_3$mim]Br, [$C_4$mim]Br, [MPCNIm]Br, [$C_4$mim]Cl, and [MPCNIm]Cl, in order from left to right.
Figures 8A, 8B, 8C, 8D, 8E, 8F:
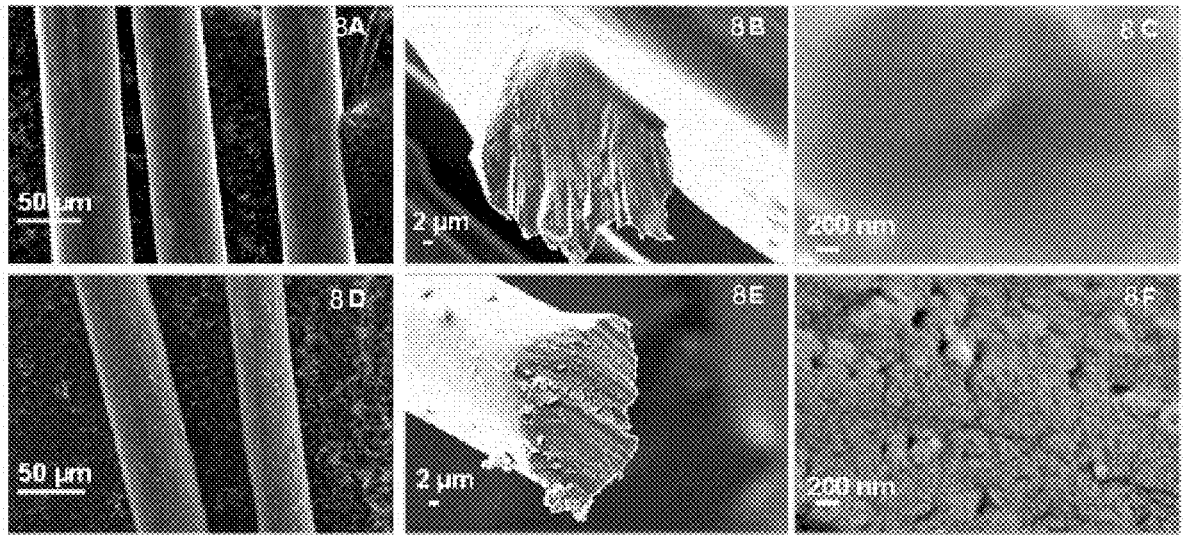
FIGS. 8A-8F. Scanning electron microscope (SEM) images of: as-spun PAN fiber from the PAN-[$C_4$mim]Br composite (FIG. 8A), cross-section of the as-spun fiber at different magnifications (FIGS. 8B and 8C), PAN fiber after washing (FIG. 8D), and cross-section of the washed fiber at different magnifications (FIGS. 8E and 8F).

Characterization of melt spun PAN fibers. Melt-spun PAN fiber from PAN-IL composites containing [$C_3$mim]Br, [$C_4$mim]Br, [MPCNIm]Br, [$C_4$mim]Cl, and [MPCNIm]Cl in order from left to right are shown in FIG. 7, and the diameters of the fibers are listed in Table 3 (below). Sample sizes for initial spinning experiments were approximately 3 grams, and it was possible to produce 60% of the original composite melt in fiber form. After the fibers were spun, both the as-spun fibers and fibers contacted with water were characterized by SEM, DSC, TGA, FTIR and WXRD, and the mechanical properties were also investigated. SEM provided the characterization of the surface morphology and the cross section of the fibers FIGS. 8A-8F are scanning electron microscope (SEM) images of: as-spun PAN fiber from the 30 wt % PAN-[$C_4$mim]Br composite (FIG. 8A), cross-section of the as-spun fiber at different magnifications (FIGS. 8B and 8C), PAN fiber after washing (FIG. 8D), and cross-section of the washed fiber at different magnifications (FIGS. 8E and 8F). In FIG. 8A, the as spun PAN-[$C_4$mim]Br fibers exhibit an overall smooth surface morphology. Commercially available PAN fibers, typically manufactured through solution spinning, exhibit rough surface morphologies where the surfaces are often deformed with long, rough grooves or striations. FIG. 8B shows the circular cross-sections of the as-spun fiber. This is a significant achievement, particularly considering that the fiber was spun at small scale using a bench-top device. A symmetric cross-section increases the prospect of the fiber exhibiting a lower porosity, which would increase the tensile strength of the fibers. The surface morphology was also analyzed after removing the residual IL from the PAN fiber. After washing, the fibers still exhibit a relatively smooth surface and no voids formed within the core of the fibers (see FIGS. 8D, 8E, and 8F). SEM revealed that the IL removal from the fibers does not generate a visual increase in inhomogeneities on the surface or within the cross-section, and this may function to enhance the mechanical properties of the final carbon fibers.

The removal of the ILs slightly lowers the diameter of the PAN fibers, as seen in Table 3 (below). Considering the quite rudimentary method employed for fiber generation and lack of precise tensioning during pulling the fiber, formation of homogeneous fibers without voids is a significant accomplishment. The fiber diameter variation can be minimized by deployment of a scaled-up fiber spinning process. These results confirm that the removal of the ILs does not have an impact on the integrity of the fibers.

TABLE 3

Diameters of Melt Spun PAN Fibers.

| Fiber Sample | As Spun Fiber Diameter (μm) | Washed Fiber Diameter (μm) |
|---|---|---|
| [$C_3$mim]Br | 56.2 ± 1.6 | 53.4 ± 7.6 |
| [$C_4$mim]Br | 56.8 ± 2.0 | 45.6 ± 7.9 |
| [$C_4$mim]Cl | 54.7 ± 0.8 | 45.3 ± 8.7 |
| [MPCNIm]Br | 59.6 ± 2.5 | 47.9 ± 14.1 |
| [MPCNIm]Cl | 53.4 ± 1.7 | 48.6 ± 10.4 |

Figure 9:
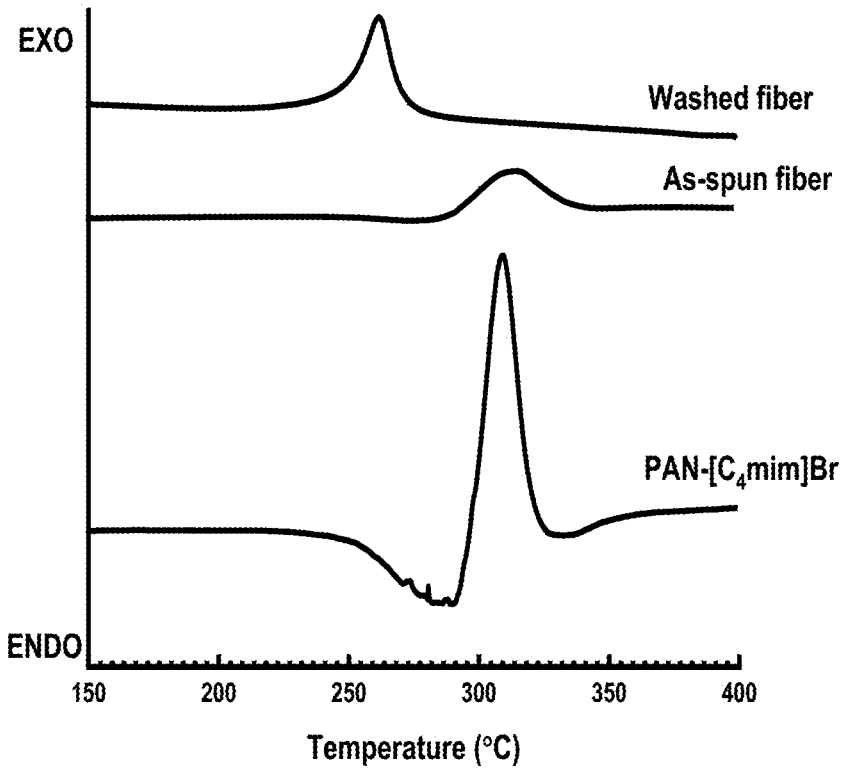
FIG. 9. DSC curves for PAN-[$C_4$mim]Br melt, as-spun fiber, and PAN fiber after washing (under nitrogen).

Secondary thermophysical characterization experiments were conducted to confirm and verify the successful realignment of polymer chains during the spinning extrusion and drawing phase. FIG. 9 shows DSC curves for PAN-[$C_4$mim]Br melt, as-spun fiber, and PAN fiber after washing (under nitrogen). FIG. 9 shows that the as-spun PAN fiber has a smaller exotherm at 300° C., lower total heat evolved over a larger temperature range, compared to the PAN-[$C_4$mim]Br composite melt. The decrease in exotherm size indicates that the PAN fibers are in favor of a subsequent oxidative stabilization process. The cyclization exotherms for the as-spun fibers appear over a larger range compared to the composite melts. For example, as shown in FIG. 9, the as-spun fiber exotherm ranges from 289° C. to 345° C. (a range of 56° C.) compared to the composite melt exotherm range of 296° C. to 333° C. (a range of 37° C.). The increased range of the exotherm for the as-spun fibers is more desirable than the smaller range or intense exotherms of the composite melts because there is a reduced chance for damage to the fibers during the oxidation process. Before the exotherm occurs, there is a small endotherm for the as-spun fibers. This endotherm is a result of the ionic liquid present within the fibers and its decomposition. After the ILs are removed from the PAN fiber precursors (by contacting with water), the exothermic performances have an even lower onset temperature (~215° C.), lower peak temperature (~262° C.), and broader DSC exotherm (~215° C. to 305° C.) compared to the as-spun fibers. The washed fibers generally have a lower heat released (ΔH), which implies that the stabilization time required for the oxidation of the fibers can be reduced. This process is where the polymer chains begin to crosslink and form the offset ladder intermediate structure, a characteristic for PAN fibers, where the PAN undergoes a transition from linear polymer chains into a more rigid, stable ladder structure. Initially, the amorphous region of the PAN stabilizes followed by the oriented crystalline regions.

Figure 10:
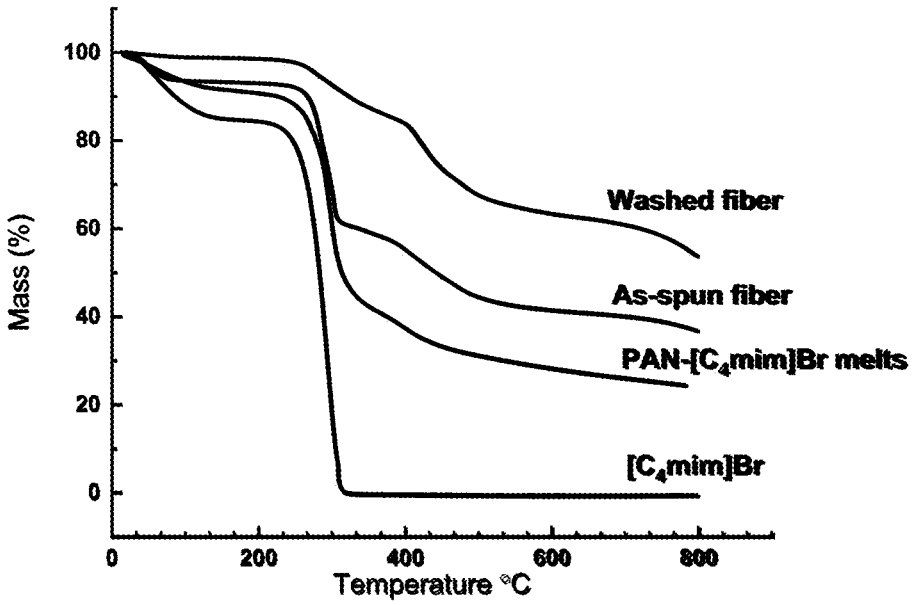
FIG. 10. TGA curves of [$C_4$mim]Br, PAN-[$C_4$mim]Br composite, as-spun PAN fiber, and washed PAN fiber.

Understanding the thermal stability at different phases of the PAN fiber precursor stabilization process can help elucidate the factors affecting the carbon yield. TGA was performed on the as-spun PAN fiber precursors and after the fiber precursors had been contacted with water. TGA plots for PAN-[$C_4$mim]Br samples are shown in FIG. 10. Initially, the IL, the 30 wt. % PAN in [$C_4$mim]Br melts, and as-spun fibers exhibit a conspicuous weight loss around 100° C. from the vaporization of water. The IL, PAN composite melt and the as-spun fiber experience a large weight loss at approximately 300° C. from the thermal degradation of the ionic liquid. These two characteristic weight losses (100 and 300° C.) are not seen for the washed fiber as most of water and the IL are removed. It was also observed that the carbon yield increased from the composite melt (24.3%) to the as-spun fiber (36.8%) and to the washed fiber (53.8%). The increase in the carbon yield is likely a direct result of the polymer chains having a higher content of oriented crystalline regions forming stronger ladder structures during stabilization. ILs containing a bromide anion result in a higher carbon yield for PAN at all stages compared to chloride-containing ILs when the ILs have the same cation. An increase in the carbon yield will result in better mechanical properties of the carbon fiber because there will be lower amount of non-carbon atoms to remove during the carbonization step.

TABLE 4

Carbon yield from TGA curves for the PAN-IL melts, as-spun fibers, and washed fibers.

| Fiber sample | Melt | As-spun fiber | Washed fiber |
|---|---|---|---|
| [$C_3$mim]Br | 20.3 | 44.4 | 53.7 |
| [$C_4$mim]Br | 24.4 | 36.8 | 53.8 |
| [$C_4$mim]Cl | 13.1 | 29.3 | 45.0 |
| [MPCNIm]Br | 26.5 | 38.4 | 58.5 |
| [MPCNIm]Cl | 21.0 | 33.1 | 52.2 |

Figure 11:
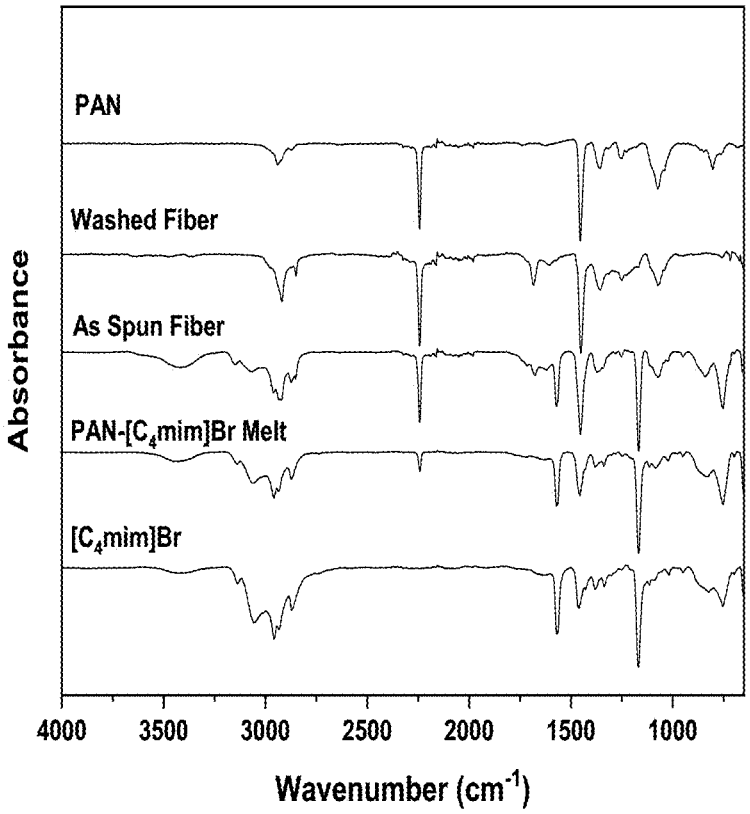
FIG. 11. FTIR spectra of [$C_4$mim]Br, PAN-[$C_4$mim]Br melt composite, as-spun PAN fiber, PAN fiber after washing, and PAN powder.

FTIR is a common technique to analyze the functional groups of PAN fibers. FTIR was used to understand the evolution of the structure of PAN-IL composite melts, as-spun fibers, and washed fibers. FIG. 11 shows the changes in the IR spectra for [$C_4$mim]Br, PAN-[$C_4$mim]Br composite melt, as-spun PAN fiber, washed PAN fiber, and neat PAN powder. The IR spectra for the [$C_n$mim]$^+$ containing IL show characteristic IR bands at 750, 820-840, 1167, 1560, and 2800-3200 $cm^{-1}$ for the alkyl and imidazolium ring stretching and bending. These bands are apparent in samples containing ILs and disappear when the PAN fibers have been washed with water. This represents that most if not all the ILs can be removed during the fiber washing procedure. As earlier noted, ILs containing halide are hygroscopic, and samples containing ILs show some water in which OH stretching can be seen around 3420 $cm^{-1}$. The band around 2240 $cm^{-1}$ for samples containing PAN is correlated to the stretching modes of C≡N nitrile groups. This stretching band is noticeably smallest for the PAN-ILs melt composites due to the decrease in polymer alignment resulting from increases in the distances between the nitrile groups of the PAN. The distance between nitrile groups decreases due to the formation of dipole pairs between the C≡N and the ILs, which indicates strong interactions between the ILs and PAN. The intensity of the stretching band intensifies when the PAN-IL composite melts are stretched into fibers as an increase in the linear structure of the PAN takes place and the distances between nitrile groups decreases. The C≡N band in the IR spectra continues to intensify after the PAN fibers are washed and ILs are removed. The removal of ionic liquids decreases the free volume between nitriles, which permits the nitrile groups to approach neighboring nitriles and increase the number of nitrile pairs. Additionally, when fibers are spun from composites containing MPCNIm$^+$ cation species, there is a small red shift in the C≡T band. A nitrile band shift to lower frequencies indicates more favorable conditions for the cyclization reactions to occur.

As shown in FIG. 11, FTIR spectra for the as-spun and washed PAN fibers exhibit new stretching bands at 1610 $cm^{-1}$ and 1680 $cm^{-1}$. These new bands are related to the stretching of C═N combined with aromatic C═C vibrations with ═N—H in-plane bending of the ladder structure and C═O groups, respectfully. The band at 1610 $cm^{-1}$ may be attributed to the initiation of the cyclization and dehydrogenation reactions from the polymer chains. The cyclization of the PAN polymer chains was initiated during the spinning process where elevated temperatures were used during melt spinning. The band intensifies as the IL is removed from the PAN fiber, which indicates the increased interactions between C═N and C═C bonds. The spectra in FIG. 10 confirm the gradual increase in the onset of cyclization of linear PAN. This partially cyclized structure exhibited by the washed fibers further confirms the lower heat evolved that was observed in the DSC analyses and the shift in stabilization exotherm to lower temperature. The partially cyclized polymer chains reduces the exothermic heat released during the stabilization stage, which shortens the residence time. This increases the amount of the ladder structure exhibited by the washed fibers and also contributes to the higher carbon yield content.

The band centered at 1680 $cm^{-1}$ corresponds to the conjugated ketone groups on the cyclic structure. The formation of this band is a result of the surface oxidation in the presence of oxygen during the fiber formation process as the band is not apparent in the PAN-IL composite melt as shown in FIG. 10. The linear PAN chains uptake oxygen forming carbonyl groups. As the temperature is increased during the melt spinning process, more carbonyl groups are formed. The formation of the new 1610 $cm^{-}$ and 1680 $cm^{-1}$ bands can be observed in each washed fiber regardless of the plasticizing IL. However, the intensity of this band is stronger for fibers formed with [$C_4$mim]Br and even more intense when [MPCNIm]Br is used as the plasticizing species. This suggests that imidazolium-based ILs with longer and bulkier substituent group and with a bromide counteranion are promising for the formation of PAN fibers by melt spinning and indicates that the selected ILs can be beneficial for the stabilization process of PAN precursors for the production of carbon fiber. For ILs containing [MPCNIm]$^+$ cations, an absorbance band exists at 2240 $cm^{-1}$, which correlates to the stretching mode of the CEN on the imidazolium substituent.

XRD patterns and calculated structural data (crystallinity, crystal size and crystalline orientation) of the as-spun PAN-IL fibers containing [$C_3$mim]Br, [$C_4$mim]Br, [MPCNIm]Br, [$C_4$mim]Cl, and [MPCNIm]Cl were obtained. For the as-spun PAN-IL fibers containing different ILs, it was found that the crystallinity was in the order of [C3mim]Br (63.4%) [$C_4$mim]Br (63.1%)>[MPCNIm]Cl (61.9%)>[$C_4$mim]Cl (49.3%)>[MPCNIm]Br (38.9%), while the crystal size of the samples are in the order of [$C_3$mim]Br (11.45 nm)>[MPCNIm]Cl (9.66 nm)>[MPCNIm]Br (8.08)>[$C_4$mim]Br (7.86 nm)>[$C_4$mim]Cl (7.11 nm) nm). Thus, the PAN-[$C_4$mim]Br fiber showed the near highest crystallinity and the second smallest crystal size. Although the crystal size of PAN-[$C_4$mim]Cl is smaller than that of PAN-[$C_4$mim]Br, the crystallinity of PAN-[$C_4$mim]Cl is very low (49.3%). For the crystallinity orientation, 78% of crystallinity orientation for PAN-[$C_4$mim]Br was higher than that of PAN-[MPCNIm]Cl (75%)~PAN-[$C_3$mim]Br (74%)~and PAN-[$C_4$mim]Br (70%), a little lower than PAN-[MPCNIm]Br (81%).

Figure 12:
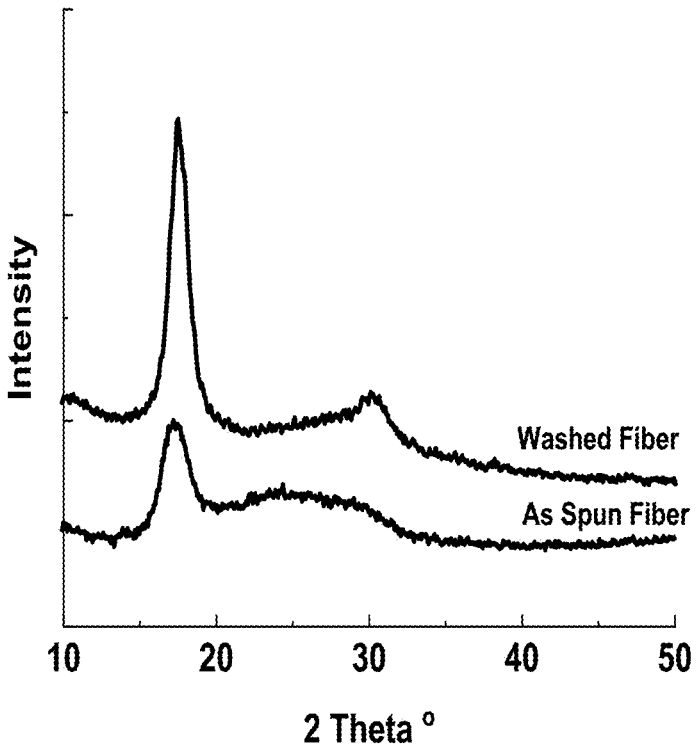
FIG. 12. XRD results of as-spun PAN-[$C_4$mim]Br and washed fibers.

The structures of the as-spun PAN-[$C_4$mim]Br and washed fibers were investigated by XRD, and the results are shown in FIG. 12. The results indicate that the removal of ILs slightly influences the crystallinity and crystal size of the PAN fibers. The as-spun fiber showed 43.9% crystallinity with 8.8 nm crystal size. Washing increased crystallinity to 69.9% and crystal size to 9.5 nm. The morphological parameters are the key factors for the mechanical properties of the fibers, which is consistent with the results as shown in the next mechanical testing section.

Mechanical testing of as-spun and washed PAN fibers. The traditional single fiber tensile testing was used to evaluate the mechanical properties of the individual PAN aprecursor fibers at each stage of the stabilization process. Measuring the mechanical properties throughout the multiple stages of the process permitted monitoring of the physical and chemical structural transformations. Single fiber tensile testing was performed using an Instron 5943 Universal Testing Machine. For each PAN-fiber, 40 samples were tested with a gauge length of 25.4 mm and a cross-head speed of 10 mm/min. The single fiber specimens were measured until break using a 10 N load cell.

Figure 13A:
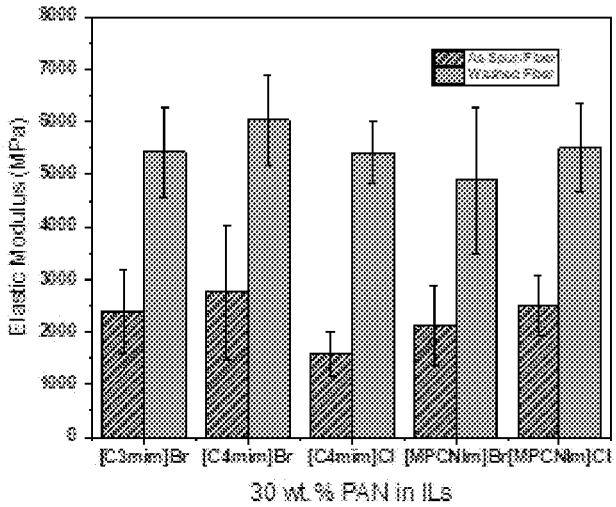
FIGS. 13A-13C. Mechanical properties of the PAN fibers produced using ionic liquids (A)-(E) and washed PAN fibers: elastic modulus (FIG. 13A), ultimate tensile strength (FIG. 13B), and extension at break (FIG. 13C).
Figure 13B:
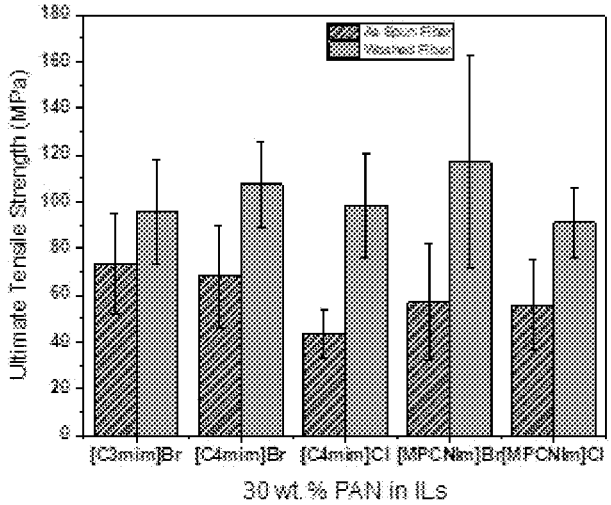
Figure 13C:
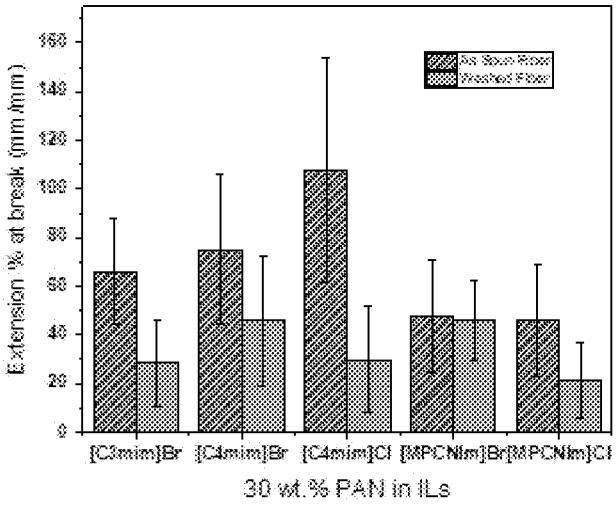

The mechanical properties for the as-spun and washed PAN fibers are shown in FIGS. 13A-13C. Elastic modulus is shown in FIG. 13A, ultimate tensile strength is shown in FIG. 13B, and extension at break is shown in FIG. 13C. Compared to the as-spun fibers, the washed PAN fibers show an increase in both the elastic modulus and tensile strength (FIGS. 13A and 13B) with reduced extension (FIG. 13C). The tensile strength and modulus are comparable to larger diameter PAN precursors where the mechanical properties are known to increase by drawing the fiber into a smaller diameter filament. The increase in elastic modulus and tensile strength of each washed PAN fiber correlates to the respective increased carbon yield exhibited when the ILs are removed from the as-spun PAN fibers. The increase in mechanical properties further supports the hypothesis that a favorable structure transformation occurs during the fiber washing or removal of the IL. The ionic liquids in the as-spun fibers act as a plasticizing medium, which results in a higher concentration of amorphous PAN polymer chains. This higher amorphous PAN concentration can result in the as-spun fibers being stretched to a greater degree compared to the washed fibers, as shown by a greater extension at break percentage (FIG. 13C).

After the removal of the ILs, the polymer chains lose the elasticity they experienced in the as-spun phase where the ILs act as a lubricant for the stretching of fibers. The as-spun PAN fibers were more ductile where the fibers could be stretched to 100% of its original length. However, when the ILs were removed, the washed PAN fibers were only able to reach a maximum extension of ~46% for fibers from PAN-[MPCNIm]Br or PAN-[$C_4$mim]Br composite melts. It is evident that PAN fibers that are produced with ILs containing a bromide anion have enhanced mechanical properties compared to PAN fibers prepared from ILs with chloride anion.

While there have been shown and described what are at present considered the preferred embodiments of the invention, those skilled in the art may make various changes and modifications which remain within the scope of the invention defined by the appended claims.

What is claimed is:

1. A method for producing polyacrylonitrile (PAN) fiber, the method comprising:

(i) mixing PAN with an ionic liquid in which the PAN is soluble to produce a PAN composite melt in which the PAN is dissolved in the ionic liquid, wherein the ionic liquid contains a counteranion that includes at least one nitrile group;

(ii) melt spinning the PAN composite melt to produce the PAN fiber; and (iii) washing the PAN fiber with a solvent in which the ionic liquid is soluble to substantially remove the ionic liquid from the PAN fiber.

2. The method of claim 1, wherein the ionic liquid does not contain chloride as anion.

3. The method of claim 1, wherein the anion of the ionic liquid is dicyanamide.

4. The method of claim 1, wherein the cation of the ionic liquid contains at least one nitrogen atom.

5. The method of claim 1, wherein the cation of the ionic liquid comprises at least one ring containing at least one ring nitrogen atom.

6. The method of claim 1, wherein the cation of the ionic liquid contains at least one nitrile group.

7. The method of claim 1, wherein the cation of the ionic liquid comprises an imidazolium ring.

8. The method of claim 7, wherein the ionic liquid has the following structure:

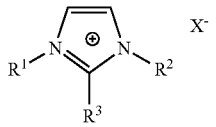

(1)

wherein: $R_1$ and $R_2$ are independently a saturated or unsaturated, straight-chained, branched, or cyclic hydrocarbon group (R) having 1-10 carbon atoms and optionally containing one or more heteroatoms selected from oxygen, nitrogen, sulfur, and fluorine atoms; $R_3$ is selected from hydrogen atom and R; and X is a counteranion that includes at least one nitrile group.

9. The method of claim 8, wherein $R_3$ is hydrogen atom.

10. The method of claim 8, wherein $X^-$ is not chloride.

11. The method of claim 8, wherein $X^-$ is dicyanamide.

12. The method of claim 1, wherein the solvent is aqueous based.

13. The method of claim 12, wherein the solvent is deionized water.

14. The method of claim 1, wherein the ionic liquid is present in a greater amount by weight than the PAN in step (i).

15. A method for producing a carbon fiber, the method comprising:

(i) mixing PAN with an ionic liquid in which the PAN is soluble to produce a PAN composite melt in which the PAN is dissolved in the ionic liquid, wherein the ionic liquid contains a counteranion that includes at least one nitrile group;

(ii) melt spinning the PAN composite melt to produce the PAN fiber;

(iii) washing the PAN fiber with a solvent in which the ionic liquid is soluble to substantially remove the ionic liquid from the PAN fiber;

(iv) oxidatively stabilizing the PAN fiber produced in step (iii); and (v) carbonizing the PAN fiber produced in step (iv) to produce said carbon fiber.

16. The method of claim 15, further comprising: (vi) subjecting the carbon fiber to graphitization.

17. The method of claim 15, wherein the ionic liquid does not contain chloride as anion.

18. The method of claim 15, wherein the anion of the ionic liquid is dicyanamide.

19. The method of claim 15, wherein the cation of the ionic liquid contains at least one nitrogen atom.

20. The method of claim 15, wherein the cation of the ionic liquid comprises at least one ring containing at least one ring nitrogen atom.

21. The method of claim 15, wherein the cation of the ionic liquid contains at least one nitrile group.

22. The method of claim 15, wherein the cation of the ionic liquid comprises an imidazolium ring.

23. The method of claim 22, wherein the ionic liquid has the following structure:

(1)

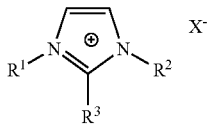

wherein: $R_1$ and $R_2$ are independently a saturated or unsaturated, straight-chained, branched, or cyclic hydrocarbon group (R) having 1-10 carbon atoms and optionally containing one or more heteroatoms selected from oxygen, nitrogen, sulfur, and fluorine atoms; $R_3$ is selected from hydrogen atom and R; and $X^-$ is a counteranion that includes at least one nitrile group.

24. The method of claim 1, further comprising: (iv) separating the removed ionic liquid from the solvent and re-using the removed ionic liquid in step (i).

* * * * *